US006332323B1

(12) United States Patent
Reid et al.

(10) Patent No.: US 6,332,323 B1
(45) Date of Patent: Dec. 25, 2001

(54) HEAT TRANSFER APPARATUS AND METHOD EMPLOYING ACTIVE REGENERATIVE CYCLE

(75) Inventors: Christopher E. J. Reid; Kenneth W. Kratschmar; John A. Barclay, all of Victoria; Adrian J. Corless, Vancouver, all of (CA)

(73) Assignee: 586925 B.C. Inc., British Columbia (CA)

( * ) Notice: Subject to any disclaimer, the term of this patent is extended or adjusted under 35 U.S.C. 154(b) by 0 days.

(21) Appl. No.: 09/513,163

(22) Filed: Feb. 25, 2000

(51) Int. Cl.[7] ..... F25B 9/00
(52) U.S. Cl. ..... 62/6; 62/467
(58) Field of Search ..... 62/6, 401, 403, 62/467

(56) References Cited

U.S. PATENT DOCUMENTS

| | | | | |
|---|---|---|---|---|
| 2,616,248 | | 11/1952 | de Brey et al. | 60/24 |
| 2,931,189 | * | 4/1960 | Sigworth | 62/6 |
| 3,478,511 | * | 11/1969 | Schwemin | 62/6 |
| 3,971,230 | | 7/1976 | Fletcher | 62/6 |
| 3,978,680 | * | 9/1976 | Schukey | 62/6 |
| 4,353,218 | | 10/1982 | Wheatley et al. | 62/6 |
| 4,408,463 | | 10/1983 | Barclay | 62/3 |
| 4,489,553 | | 12/1984 | Wheatley et al. | 60/516 |
| 4,490,974 | * | 1/1985 | Colgate | 60/520 |
| 4,514,979 | | 5/1985 | Mohr | 60/512 |
| 4,704,871 | | 11/1987 | Barclay et al. | 62/3 |
| 4,858,441 | | 8/1989 | Wheatley et al. | 62/6 |
| 5,172,554 | | 12/1992 | Swift et al. | 62/6 |
| 5,239,833 | * | 8/1993 | Fineblum | 62/6 |
| 5,339,640 | * | 8/1994 | Reinke | 62/6 |
| 5,339,653 | | 8/1994 | DeGregoria | 62/467 |
| 5,457,956 | | 10/1995 | Bowman et al. | 60/520 |
| 5,465,781 | | 11/1995 | DeGregoria | 165/8 |
| 5,477,687 | | 12/1995 | Horn | 62/6 |
| 5,632,149 | | 5/1997 | Tanigawa et al. | 62/6 |
| 5,813,234 | * | 9/1998 | Wighard | 62/6 |
| 5,887,449 | | 3/1999 | Pecharsky et al. | 62/3.1 |
| 5,934,076 | | 8/1999 | Coney | 60/617 |

* cited by examiner

*Primary Examiner*—William C. Doerrler
(74) *Attorney, Agent, or Firm*—Oyen Wiggs Green & Mutala

(57) ABSTRACT

This application relates to a heat transfer apparatus and method employing an active regenerative cycle. The invention employs a working or "active" fluid and a heat transfer fluid which are physically separated. The working fluid is contained in an array of refrigeration elements that are distributed over the temperature gradient of a regenerative bed. The work for the refrigeration cycle is provided by alternative compression and expansion of the working fluid in each of the refrigeration elements at a temperature corresponding to the element's location in the temperature gradient. The compression and expansion strokes may be coupled together for optimum work recovery. The heat transfer fluid is circulated relative to the working fluid between a thermal load and a heat sink to enact a refrigeration cycle having improved energy efficiency.

49 Claims, 20 Drawing Sheets

Note: Element T-S cycles are overlapped $$\dot{Q}_{in,CYCLE} = \dot{Q}_{in,1} + \dot{Q}_{in,2} + \dot{Q}_{in,3} + \ldots + \dot{Q}_{in,N}$$

$$\dot{Q}_{out,CYCLE} = \dot{Q}_{out,1} + \dot{Q}_{out,2} + \dot{Q}_{out,3} + \ldots + \dot{Q}_{out,N}$$

$$\dot{W}_{CYCLE} = \dot{W}_1 + \dot{W}_2 + \dot{W}_3 + \ldots + \dot{W}_N$$

HEAT TRANSFER APPARATUS AND METHOD EMPLOYING ACTIVE REGENERATIVE CYCLE

TECHNICAL FIELD

This application relates to a heat transfer apparatus and method employing an active regenerative cycle. The invention employs a working fluid and a heat transfer fluid which are physically separated. The working fluid is contained in an array of discrete elements that are distributed over the temperature profile of a regenerative bed located between a thermal load and a heat sink. The work for the cycle and temperature differences for heat transfer are provided by alternating compression and expansion of the working fluid. The heat transfer fluid is circulated relative to the working fluid between the thermal load and the heat sink to enact a regenerative cycle having improved energy efficiency.

BACKGROUND

A conventional "vapor-compression" refrigeration cycle employs a single refrigerant that is circulated through a conduit between a heat sink and a thermal load. This cycle relies on the thermodynamic principles of adiabatic compression (temperature increase), isenthalpic expansion (temperature decrease) and latent heat of vaporization or condensation of a fluid.

Refrigerants, such as chlorofluorocarbons, hydrochlorofluorocarbons and hydrofluorocarbons, are typically liquids at ambient temperatures. At one stage in the refrigeration cycle, the refrigerant passes through a compressor that increases its pressure and temperature, causing it to release heat as it condenses from a vapor to a liquid form in a condensing heat exchanger. At another stage in the cycle, the liquid refrigerant passes through an expansion valve to reduce its pressure and temperature, creating a two phase fluid. This reduction in temperature causes the refrigerant to absorb heat and evaporate within the evaporative heat exchanger. In this conventional cycle, the "working fluid", which is compressed and expanded as it circulates, and the "heat transfer fluid", which accepts heat from the thermal load and rejects heat to the heat sink, are the same thing, namely the volatile refrigerant. The compressor and expansion valve are physically separated, the compressor being at the "hot end" of the cycle and the expansion valve being at the "cold end" of the cycle. The condensing heat exchanger rejects heat to the heat sink while the evaporative heat exchanger absorbs heat from the thermal load.

Regenerative thermodynamic cycles that use regenerators for periodic heat exchange are known in the prior art. In most cases the regenerator is a material which has a large thermal mass and heat transfer surface. In typical regenerative cycles the regenerator is a passive element that is not capable of doing work and whose purpose is to transfer heat back and forth to a working gas periodically during the cycle to enable larger temperature spans to be achieved. The working gas continues to be compressed at the hot end of the cycle and expanded at the cold end of the cycle. Moreover, the working gas is the same gas which is used to transfer heat from the cooled space to the environment via heat exchangers. Stirling, Gifford-McMahon and Orifice Pulse Tube devices are all examples of prior art refrigeration systems employing passive regeneration.

Stirling cycle devices operate on a regenerative thermodynamic cycle, with cyclic isothermal compression and isothermal expansion of the working fluid at different temperature levels, separated by constant volume flow through regenerators with a temperature span from the two different temperatures of compression and expansion. Stirling cycle devices have been used as heat engines, heat pumps, and refrigerators.

In a Stirling cycle machine operating as a prime mover, the working fluid isothermal compression takes place in the hotter chamber, while most of the isothermal expansion takes place in the colder chamber. Some of the heat introduced at the hot chamber is converted to work in the prime mover and the residual heat is rejected at the cold chamber. As will be appreciated by those skilled in the art, when the Stirling cycle is used in a refrigerating machine rather than a prime mover, the working fluid isothermal expansion that absorbs heat occurs in the cold chamber while the isothermal compression of the working fluid, during which heat is rejected, takes place in the hot chamber. In either type of machine the working fluid is shifted between the two chambers through a passive regenerator which is not itself capable of doing work.

In prior art Stirling cycle machines, the "working fluid" which is alternatively compressed and expanded may either be a gas or liquid. For example, U.S. Pat. No. 5,172,554 dated Dec. 22, 1992, Swift et al., discloses a Stirling thermodynamic cycle refrigerator that utilizes a single phase solution of liquid $^3$He as the working fluid. The liquid $^3$He may be present in superfluid $^4$He. As in conventional Stirling cycles, a passive regenerator is employed as a thermal reservoir that maintains a temperature difference between the compressor and expander and functions as a thermal reservoir that cyclically exchanges heat with the working fluid. Work is applied to the working fluid during the Stirling cycle in the compressor and expander rather than within the passive regenerator itself.

U.S. Pat. No. 4,353,218 dated Oct. 12, 1982, Wheatley et al., relates to a heat pump/refrigerator using working fluid that is continuously in a liquid state. The Wheatley apparatus includes a pair of heat exchangers respectively coupled to a thermal load and a heat sink, a displacer forming a pair of reservoirs coupled to the different heat exchangers, a regenerator connecting the heat exchangers, and means for compressing a working fluid that can pass between the reservoirs by way of the regenerator and a heat exchanger. The working fluid may consist of, for example, compressed polypropylene. As in other similar prior art systems, the regenerator is utilized to transfer heat from the working fluid leaving one heat exchanger into fluid leaving the other heat exchanger and does not input work into or remove work from the system.

"Active regenerators" utilize heat transfer materials that not only have large thermal masses and heat transfer surfaces but are also capable of doing work during a thermodynamic cycle. Heretofore active refrigerants have been solids, such as magnetic materials or elastomers. For example, U.S. Pat. No. 4,704,871, Barclay et al., issued Nov. 10, 1987, relates to magnetic refrigerators employing paramagnetic or ferromagnetic materials. When such materials are adiabatically passed into and out of a magnetic field (such as produced by a superconducting magnet) their temperature alternatively increases and decreases. This is referred to as the magnetocaloric effect. By way of example, if Gadolinium at room temperature is adiabatically subjected to a magnetic field of about 8 Tesla it will increase its temperature by about 12–14 K. A refrigeration cycle may be enacted by passing a heat transfer fluid between hot and cold heat exchangers in a periodic flow as the magnetic material is alternatively adiabatically magnetized and demagnetized.

One significant problem associated with active regenerative systems employing the magnetocaloric effect is the cost of developing adequate adiabatic temperature changes especially for near room temperature use. Magnetic systems require powerful superconducting magnets to achieve magnetic fields large enough to cause modest temperature ratios. Such superconducting magnets are very expensive and not practical for many applications and the energy required to keep the superconducting magnets cold makes the entire cycle inefficient with the exception of very large systems.

Elastomeric materials may also be used as an active heat transfer element in a regenerative system. U.S. Pat. No. 5,339,653 dated Aug. 23, 1994, DeGregoria, describes refrigeration cycles based on the thermoelastic effect in which certain elastomers, such as rubber, warm upon stretching and cool upon contracting. In particular, a regenerative bed may be formed comprising a porous matrix of elastomeric sheets arranged in layers with spacers between the sheets defining fluid flow channels. Work may be inputted into or removed from the system by periodically stretching and contracting the elastomeric sheets to effect temperature changes. A circulator passes a heat transfer fluid through the porous matrix in one direction when the bed is at one temperature or stretch and in the reverse direction when the bed is at a different temperature or stretch.

The significant problems associated with active regenerative systems employing the thermoelastic effect include the large strains (~4–10) required to achieve modest temperature change (~20 K), hysteretic effects and crystallization of the elastomer after prolonged use or upon cooling significantly below room temperature.

While the use of solid heat transfer regenerative materials capable of doing work, such as magnetic or elastomeric materials, is known in the prior art, the use of an active or "working" fluid capable of doing work in a regenerative refrigeration cycle has not been previously described as a means of improving thermal efficiency. The need has therefore arisen for an active regenerative refrigerator that comprises a working fluid separate from the heat transfer fluid and which is distributed over the temperature profile of a regenerative bed. The need has also arisen for an active regenerative refrigerator of modular design that may be easily tailored to meet the heat transfer requirements of different applications, thereby achieving optimum versatility.

Since the present invention achieves improved thermodynamic efficiency, it has many potential cryogenic and near room temperature applications. For example, vehicles that operate on liquefied natural gas are particularly attractive as an alternative to gasoline-based vehicles in that they utilize a domestically available fuel, generate less pollution and have significantly lower maintenance costs. The refueling stations needed to service vehicles operating on liquefied natural gas will require relatively inexpensive refrigerators to liquefy the gas delivered through pipelines that operate at ambient temperature.

Numerous high temperature superconductor devices provide the promise of improved electronic performance provided cost-effective refrigeration systems are available to cool the electronics down to near or below liquid nitrogen temperatures. The present cost of cryogenic cooling systems, however, makes circuitry that utilizes superconductors impractical for consumer applications.

The generation of liquid oxygen for use in sewer treatment plants would likewise benefit from more cost-effective refrigeration systems. Oxygen is bubbled through aerobic digestion ponds to increase the speed at which waste products are oxidized. The oxygen is typically generated on site by cryogenic liquefaction of air. It would be advantageous to be able to increase the efficiency of such cryogenic systems, thereby lowering the cost of generating the liquid oxygen.

Prior art cryogenic refrigeration systems with large cooling capacities typically depend upon large compressors that generate a great deal of vibration and have limited lifetimes. The need to isolate the vibration and reduce the noise further increases the cost of the systems. It would be clearly advantageous to avoid cryogenic systems that have moving parts and seals requiring periodic replacement.

With the introduction of the Montreal Protocol the initial objectives of reducing emissions of ozone depleting gases, most of which came from the near room temperature refrigeration industry, have been stated. Its implementation has caused the substitution of the CFC refrigerants with similar compounds with less ozone damaging potential. Unfortunately some of the new ozone friendly refrigerants are inferior to previous refrigerants and have reduced the efficiency of some refrigeration equipment.

The newest environmental challenge is the reduction of greenhouse gas emissions. In the case of the near room temperature refrigeration industry, increasing the efficiency of refrigerating devices will help reduce such emissions.

There are many applications in the near room temperature market including air-conditioners, refrigerators, freezers and heat pumps. Vapor compression technology is used in the vast majority of products for these markets and has been under continuing improvement for approximately 100 years. The efficiency of the current products can be increased slightly but only with an increase in capital cost. A refrigerating system with improved efficiency and similar or reduced capital cost would be highly advantageous.

SUMMARY OF THE INVENTION

In accordance with the invention, a heat transfer apparatus employing an active regenerative cycle for transferring heat from a thermal load to a heat sink is provided. The apparatus comprises a contained working fluid; a heat transfer fluid physically separated from the working fluid and in thermal communication with the thermal load and the heat sink; work input means for periodically compressing and expanding the working fluid to alternatively increase and decrease the temperature thereof; and circulation means for circulating the heat transfer fluid relative to the working to either accept heat from or transfer heat to the working fluid.

Preferably the working fluid is contained within at least one first vessel. The work input means is moveable relative to the first vessel to compress a first sub-volume of the working fluid in a first portion of the first vessel and simultaneously cause expansion of a second sub-volume of the working fluid in a second portion of the first vessel, thus enabling work recovery. In one embodiment of the invention a plurality of separate first vessels are arranged in an ordered array, each of the first vessels having a designated location between the thermal load and the heat sink. Each of the first vessels is thermally isolated from the remainder of the first vessels such that the operating temperature of each of the first vessels depends upon its designated location (i.e. its location in the temperature gradient between the thermal load in the heat sink). In this embodiment the heat transfer fluid flows over the surface of each of the first vessels in the array. In an alternative embodiment, the heat transfer fluid may flow through a second vessel contained within the first vessel(s). In this alternative embodiment the working fluid is compressed and expanded externally to the heat transfer fluid.

A method of enacting an active regenerative refrigeration cycle is also disclosed. The cycle comprises:

(A) providing a contained working fluid;

(B) providing a heat transfer fluid physically separated from the working fluid and movable between a thermal load and a heat sink;

(C) compressing the working fluid to increase the temperature thereof;

(D) moving the heat transfer fluid relative to the working fluid in a flow direction from the thermal load toward the heat sink;

(E) expanding the working fluid to decrease the temperature thereof: and (F) moving the heat transfer fluid relative to the working fluid in a flow direction from the heat sink toward the thermal load.

A regenerative heat transfer device for transferring heat between a thermal load and a heat sink is also disclosed. The heat transfer device generally comprises (a) an array of discrete refrigeration elements spaced apart at intermediate locations between the thermal load and the heat sink, wherein each of the refrigeration elements contains a working fluid and has a mean operating temperature corresponding to its location between the thermal load and the heat sink; (b) an actuator for periodically compressing and expanding the working fluid to thereby increase or decrease the temperature of the refrigeration elements; and (c) a circulator for circulating a heat transfer fluid in a flow path between the thermal load and the heat sink, wherein the heat transfer fluid passes relative to the array of refrigeration elements to either accept heat from or transfer heat to the refrigeration elements.

Preferably the actuator includes means for varying the volume of the refrigeration elements and the working fluid in each of the refrigeration elements is compressed and expanded in unison. For example, the actuator may comprise a reciprocating piston or a rotary drive for rotating the array of refrigeration elements.

Each individual refrigeration element may comprise (a) a container for holding a working fluid; (b) at least one conduit extending within or surrounding the container for holding a heat transfer fluid separate from the working fluid; and (c) an actuator for periodically compressing and expanding the working fluid to vary the temperature of the working fluid.

A regenerative refrigerator having improved thermal efficiency comprises a plurality of refrigeration elements as described above operatively coupled together such that the heat transfer fluid in adjacent pairs of elements is in fluid communication. The refrigeration elements are otherwise thermally isolated so that a temperature gradient between the thermal load and the heat sink is maintained.

BRIEF DESCRIPTION OF DRAWINGS

In drawings which describe embodiments of the invention but which should not be construed as restricting the spirit or scope of the invention in any way.

DETAILED DESCRIPTION OF THE PREFERRED EMBODIMENT

Figure 1A:
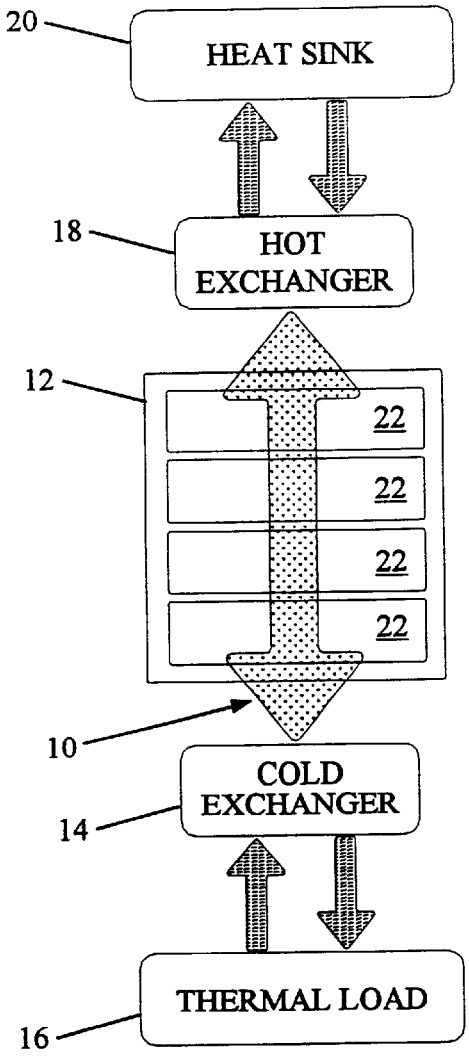
FIG. 1*a* is a block diagram illustrating the basic concept of the invention.

This application relates to a heat transfer apparatus and method employing an active regenerative cycle. The invention may be used, for example, to configure a regenerative refrigerator having improved energy efficiency. With reference to FIG. 1*a*, the invention exhibits some features common to any regenerative refrigerator, namely a means for reciprocally exchanging a heat transfer fluid 10 across a regenerative bed 12 between a cold heat exchanger 14, coupled to a thermal load 16, and a hot heat exchanger 18, coupled to a heat sink 20. Regenerative bed 12 maintains a temperature gradient between the cold and hot heat exchangers 14, 18 to enable heat flow from load 16 to sink 20. In some embodiments of the invention, heat exchangers 14, 18 may be as simple as piping for passing heat transfer fluid 10 between regenerative bed 12 and load 16 or sink 20.

A unique feature of applicants' invention is the design of regenerative bed 12. Bed 12 comprises a plurality of refrigeration elements 22 each containing a working fluid 24 that is alternatively compressed and expanded. As used in this patent application the terms "regenerator" and "regenerative bed" refer to a periodic heat exchanger which transfers heat to and accepts heat from a heat transfer fluid during each cycle of operation.

At least one refrigeration element 22 is required in order to create a cooling effect. The extent of the cooling effect is dependent on several factors including the amount and type of working fluid 24 contained in refrigeration element 22, the compression/expansion ratio of working fluid 24, the surface area of element 22 available for heat transfer and the temperature of heat exchangers 14, 18. For most applications a plurality of refrigeration elements 22 are required to produce a cooling effect of practical utility. As described further below, regenerative bed 12 preferably comprises an array of elements 22 spaced at intermediate locations between heat exchangers 14, 18 to achieve a larger temperature gradient and hence lower cooling temperatures.

Refrigeration elements 22 located at different intermediate locations in regenerative bed 12 have different operating temperatures. As explained further below, the temperature differences between each adjacent refrigerator element 22 in the array should be as small as possible and hence a large number of elements 22 are preferably employed to achieve optimal thermodynamic efficiency. At each intermediate location in bed 12 a bank of refrigeration elements 22 may be provided for increasing the overall heat transfer capacity of the system.

Applicants' invention is referred to as an "active" regeneration system since each refrigeration element 22 is capable of doing work. The work necessary to enact a refrigeration cycle is inputted into the system by alternatively compressing and expanding working fluid 24. This causes the temperature of each refrigeration element 22 to alternatively increase and decrease in an amount that depends upon its position in regenerative bed 12. Notwithstanding the fluctuations in temperature of elements 22, the temperature gradient across regenerative bed 12 is maintained. Flow of heat transfer fluid 10 across regenerative bed 12 is synchronized with the strokes of compression and expansion of the working fluid 24 within elements 22.

Figure 1B:
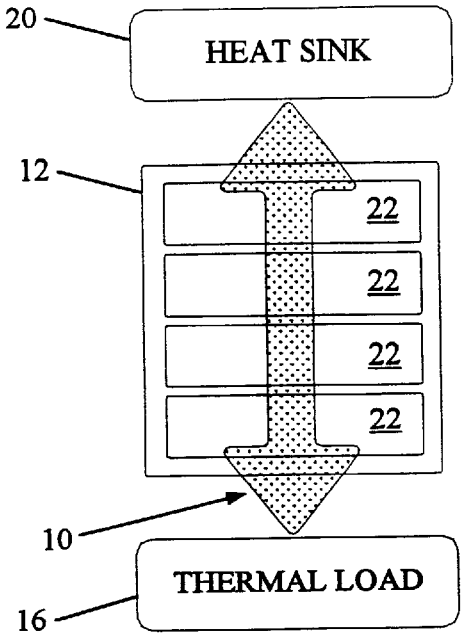
FIG. 1*b* is a block diagram of an alternative embodiment of the invention allowing heat transfer between a thermal load and a heat sink without the use of heat exchangers.

As shown schematically in FIG. 1*b*, since heat transfer fluid 10 and working fluid 24 are physically separated, ambient air may potentially be used as heat transfer fluid 10 in an open cycle (which eliminates the need for heat exchangers 14, 18 as discussed further below).

Figure 1C:
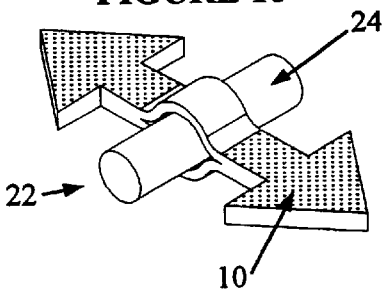
FIG. 1*c* is an isometric view of a single refrigeration element containing working fluid located within a vessel containing heat transfer fluid.
Figure 1D:
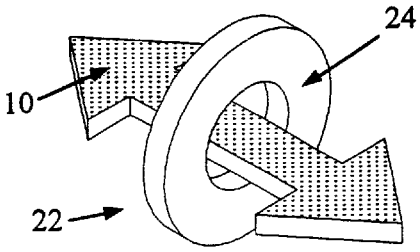
FIG. 1*d* is an isometric view of an alternative refrigeration element wherein the working fluid is contained externally to the heat transfer fluid.

As described further below, heat transfer fluid 10 and working fluid 24 are physically separated and do not mix. Heat transfer fluid 10 thermally couples refrigeration elements 22 together by either accepting or depositing heat as it passes relative to elements 22 across regenerative bed 12. In one embodiment, heat transfer fluid 10 may flow externally to working fluid 24 contained within one or more vessels (FIG. 1*c*). Alternatively, working fluid 24 may be contained in a vessel externally of the heat transfer fluid (FIG. 1*d*). For example, as described further below, heat transfer fluid may be circulated through a plurality of parallel tubes surrounded by working fluid contained within a larger vessel.

As used in this patent application the term "working fluid" refers to a fluid that may be compressed and expanded to effect a temperature change. As will be apparent to a person skilled in the art, a large number of different gases may be employed as working fluid 24. Examples of suitable working fluids 24 include common gases (e.g. helium, air, nitrogen, argon etc.), hydrocarbon gases (e.g. methane, ethane, propane etc.) and conventional refrigerants (e.g. CFC, HCFC, HFC, ammonia, etc.). The choice of working fluid 24 may depend upon the location of a particular refrigeration element 22 in the temperature gradient spanning regenerative bed 12. That is, the properties of the working fluid 24 at the temperature it is expected to operate in bed 12 is a prime criteria used to select a suitable fluid. In some cases, working fluid 24 could comprise a mixture of different gases in a pre-determined proportion. Tailoring the selection of working fluid 24 in this manner has the potential to improve the thermal efficiency and versatility of the refrigeration cycle. Although working fluid 24 will typically be in a gaseous state, it may also be present in a liquid state or as a gas/liquid mixture (e.g. a gas near its critical point).

Each refrigeration element 22 preferably comprises a dual compressor and expander. That is, compression of working fluid 24 in one chamber of element 22 simultaneously causes expansion of working fluid in a separate chamber of element 22. Accordingly, a portion of the energy inputted during the compression stroke is simultaneously recovered during a corresponding expansion stroke within the same element 22 (and hence at the same location in the temperature gradient). In other words, there is recovery of some of the compression work during the refrigeration cycle by directly coupling the compression step to an expansion step occurring at nearly the same temperature. This potential for maximum work recovery is an important feature of several embodiments of applicants' invention. By contrast, in conventional vapor-compression refrigerators, gas expansion occurs isenthalpically with no work recovery thereby reducing the thermal efficiency of the cycle.

As indicated above, flow of heat transfer fluid 10 across regenerative bed 12 is synchronized with the cycles of compression and expansion of the working fluid 24 within multiple refrigeration elements 22. During the expansion step (or very shortly thereafter) a pulse of heat transfer fluid 10 is circulated across bed 12 in a direction toward cold heat exchanger 14. During this hot blow heat transfer fluid 10 deposits heat to elements 22. The portion of heat transfer fluid 10 closest to cold heat exchanger 14 is circulated into exchanger 14 thereby cooling thermal load 16. Conversely, during the compression step (or shortly thereafter) a pulse of heat transfer fluid 10 is circulated across bed 12 in the opposite direction toward hot heat exchanger 18. During this cold blow heat transfer fluid accepts heat from refrigeration elements 22. The portion of heat transfer fluid closest to hot heat exchanger 18 is circulated into exchanger 18 thereby causing rejection of heat into heat sink 20.

Heat transfer fluid 10 may therefore be viewed as oscillating in a direction either toward cold heat exchanger 14 or toward hot heat exchanger 18 during each fluid pulse. The displacement of fluid 10 must be greater than the distance between adjacent elements 22 in the array in order to enable thermal communication therebetween. The optimum displacement distance of heat transfer fluid 10 depends upon a number of factors including the number and spacing of refrigeration elements 22. In one embodiment of the invention the amplitude of the oscillation may be a fraction of the overall size of regenerative bed 12 (i.e. a fraction of the distance between the uppermost and lowermost refrigeration elements 22 in the array).

Heat transfer fluid 10 may be propelled across regenerative bed 12 by means of a conventional fluid pump (not shown). Valves operating at ambient temperature may also be provided for reversing the direction of fluid flow relative to bed 12. As is the case for all regenerative systems, the thermal conductance from thermal load 16 to heat sink 20 through regenerative bed 12 should be low for efficient operation of the invention. Further, the pressure drop of heat transfer fluid 10 across regenerative bed 12 should also be low for optimum efficiency.

Figure 2A:
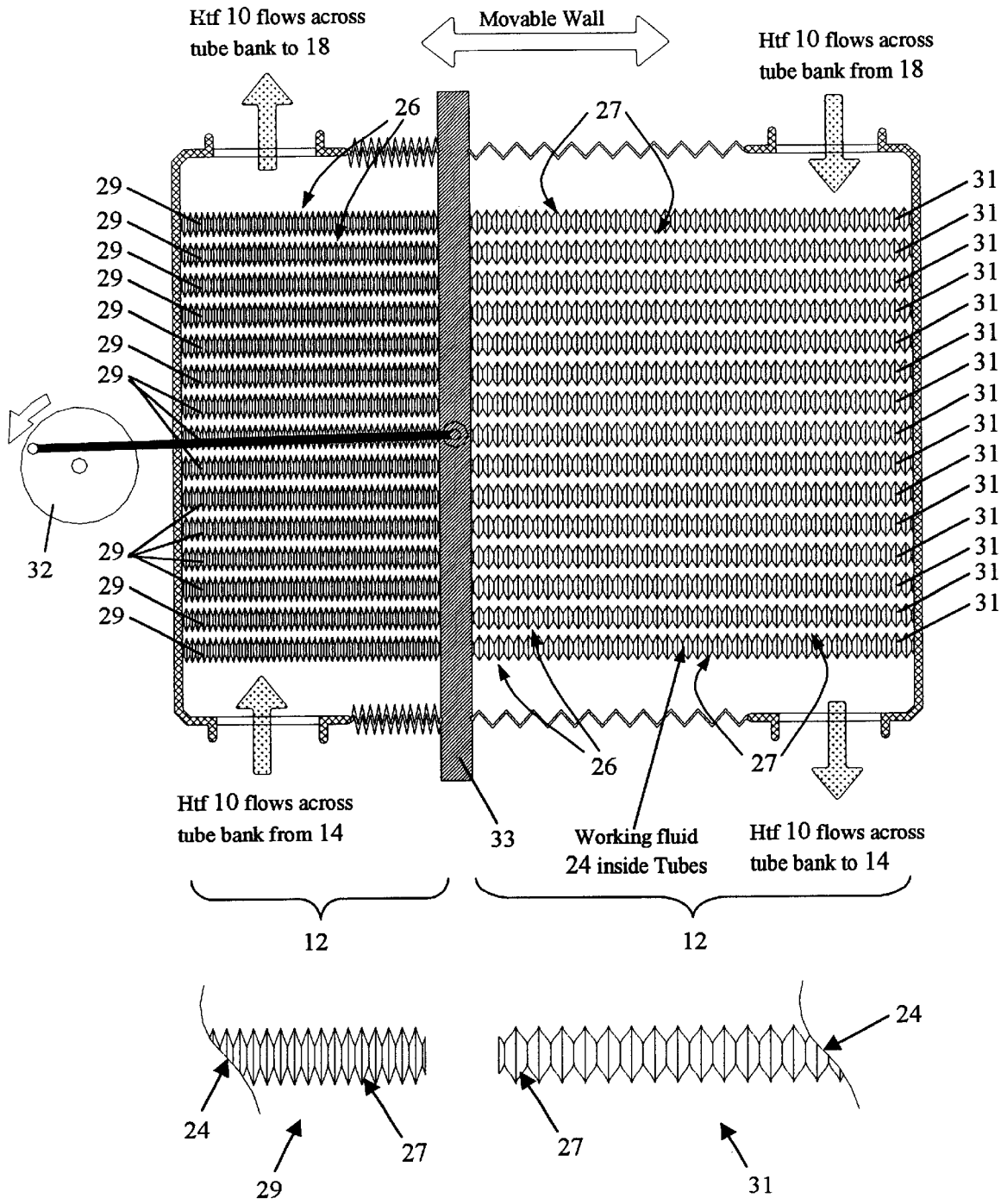
FIG. 2*a* is a side view of a first embodiment of the invention comprising an array of variable volume regenerator tubes each having flexible walls.
Figure 2B:
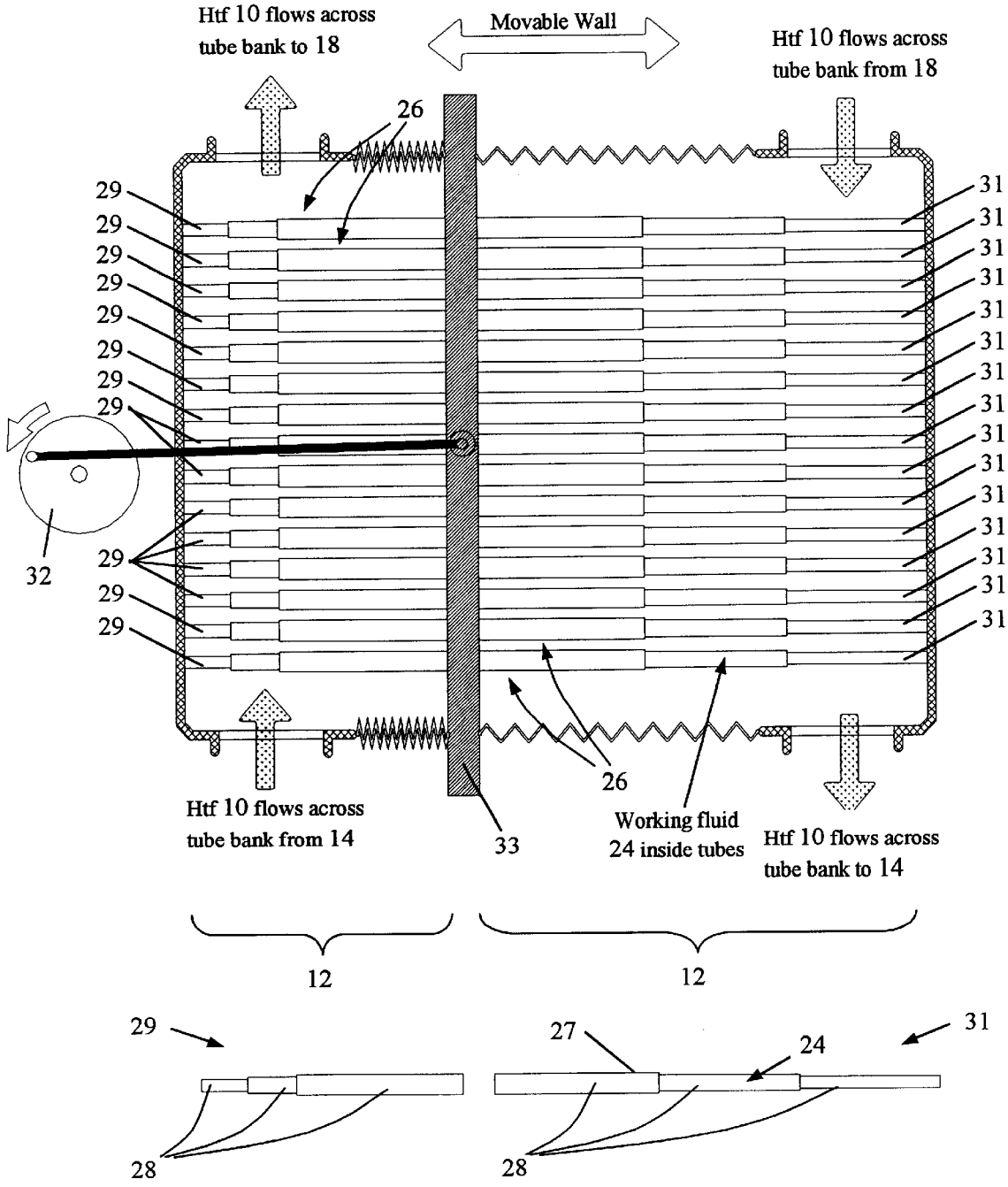
FIG. 2*b* is a side view of a further first embodiment of the invention comprising an array of variable volume regenerator tubes each having extensible telescopic segments.

FIGS. 2*a* and 2*b* illustrate a first embodiment of the invention. In this embodiment refrigeration elements 22 comprise a plurality of elongate regenerator tubes 26 disposed in a parallel array between the hot and cold ends of regenerative bed 12. Tubes 26 each include an outer wall 27 forming a hermetic shell for containing working fluid 24. Since the ratio of thermal mass of tubes 26 to working fluid 24 should be small, tube walls 27 are preferably constructed from very thin metal (e.g. <0.1 mm)

In the embodiment of FIGS. 2*a* and 2*b* each regenerator tube 26 has a variable volume. For example, tube walls 27 may be flexible to permit alternating contraction and extension thereof as shown in FIG. 2*a*. Preferably each tube 26 is subdivided into a first chamber 29 and a second chamber 31 which are physically separated, such as by a moveable central wall 33. Wall 33 is reciprocated back and forth by a work input driver to alternatively increase and decrease the volume of chambers 29, 31 (and thereby compress and expand working fluid 24 contained therein). For example, as working fluid 24 is compressed in each first chamber 29, working fluid 24 in the corresponding second chamber 31 is simultaneously expanded, and vice versa. As explained above, this dual compression/expansion enables effective work recovery.

Heat transfer fluid 10 is periodically circulated over the surface of tubes 26 between the hot and cold heat exchangers 14, 18 in synchrony with the compression and expansion strokes. In the embodiment of FIG. 2*a*, heat transfer fluid 10 flows in a direction perpendicular to the longitudinal axes of tubes 26 in two parallel ducts disposed on either side of central wall 33. In particular, heat transfer fluid 10 is circulated in the direction of the upward arrow in a first duct from the cold heat exchanger 14 to the hot heat exchanger 18 over the relatively hot surfaces of tube chambers 29 containing compressed working fluid 24. Simultaneously, heat transfer fluid 10 is also circulated in the direction of the downward arrow in a second duct from the hot exchanger 18 to the cold heat exchanger 14 over the relatively cool surfaces of tube chambers 31 containing expanded working fluid 24. The work is inputted into the refrigeration cycle by the reciprocal motion of the central wall 33. The direction of flow of heat transfer fluid 10 in the first and second ducts is periodically reversed as wall 33 reciprocates back and forth.

As will be apparent to a person skilled in the art, the flow path of heat transfer fluid 10 between heat exchangers 14, 18 through the first and second ducts need not be linear. Heat transfer fluid 10 may be piped through radially extending channels, spiral coils or any other suitable geometric arrangement. However, in order to optimally transfer heat to sink 20, the flow path must not be interrupted.

Since each regenerator tube 26 is a dual compressor and expander in the embodiment of FIG. 2*a*, the array of parallel tubes 26 effectively defines two parallel regenerative beds 12 on opposite sides of central wall 33. Both regenerative beds 12 extend between the same heat exchangers 14, 18, but contain heat transfer fluid 10 flowing in opposite directions. Other alternative tube arrangements could envisioned defining four or more discrete regenerative beds 12 all functioning simultaneously.

FIG. 2*b* illustrates another example of the first embodiment of the invention having regenerator tubes 26 of variable volume. In this embodiment, each regenerator tube 26 consists of a plurality of telescopic sections 28 which may be axially extended or collapsed to vary the volume of chambers 29, 31. Extension and contraction of tube sections 28 is activated by reciprocation of a central wall 30 comprising flexible bellows. Wall 33 is connected to the innermost tube sections 28 and prevents fluid communication between tube chambers 29, 31. Reciprocal movement of wall 33 is driven by an actuator 32. As in the embodiment of FIG. 2*a*, circulation of heat transfer fluid 10 across tubes 26 is timed to the contraction and expansion strokes.

As will be apparent to a person skilled in the art, similar cycles of expansion and compression could be effected in other ways using flexible bellows coupled to a reciprocating drive. For example, end portions of tubes 26 could be coupled to the moveable bellows rather than a central wall.

One of the advantages of applicants' invention is that a benign gas may be used as the heat transfer fluid 10 rather than a volatile refrigerant. In one embodiment of the invention illustrated in FIG. 2*c* the heat transfer fluid 10 may be air which is alternatively passed back and forth over the surface of regenerative beds 12. This embodiment is suitable for applications where the medium to be cooled is air, particularly near room temperature cooling as in refrigerators, freezers, air conditioners and the like. In this embodiment cold and hot heat exchangers 14, 18 are not required (thereby making this embodiment much simpler and less expensive to manufacture). The removal of heat exchangers 14, 18 also improves the overall thermal efficiency of the system.

Figure 2C:
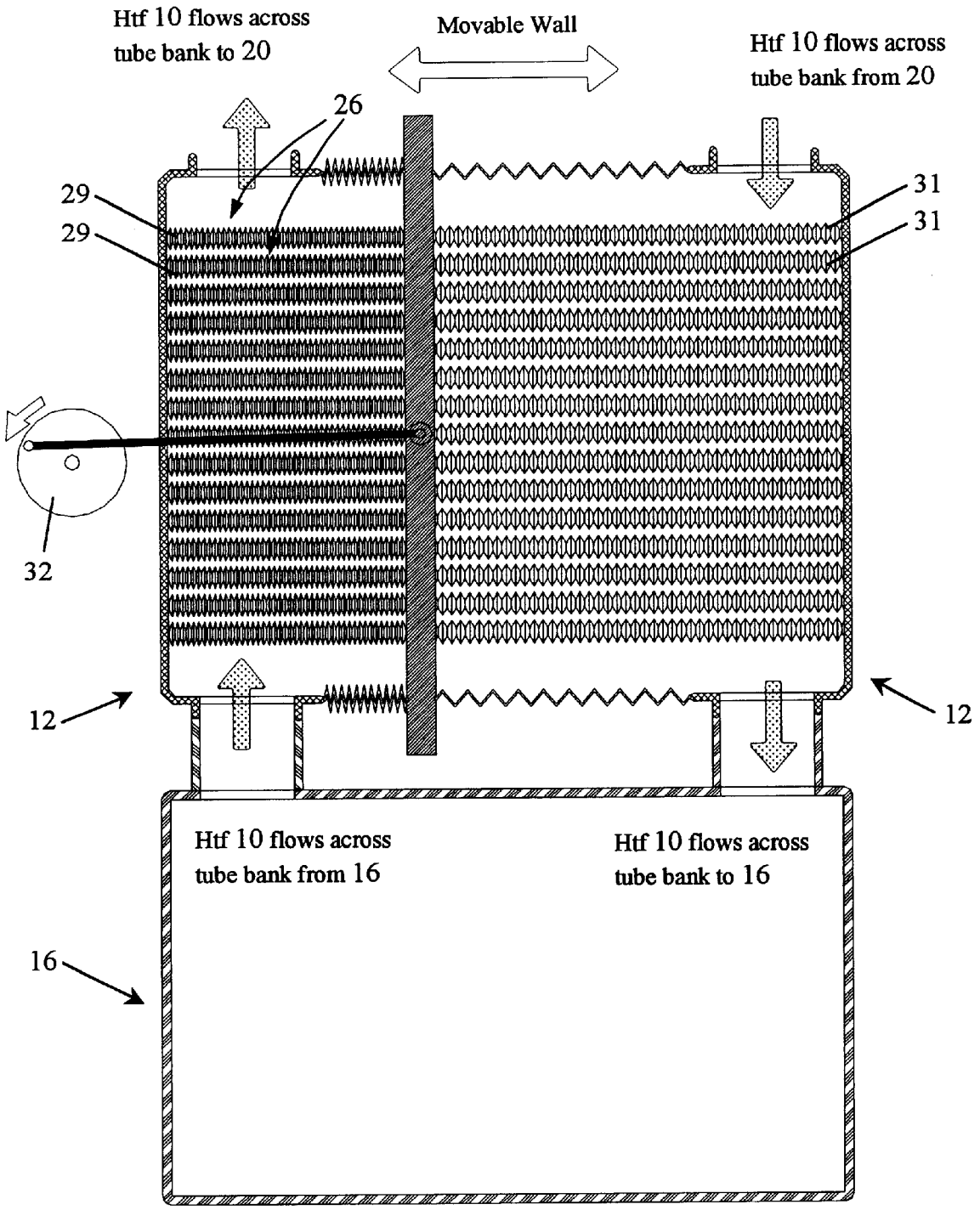
FIG. 2*c* is a side view of a variation of the embodiment of FIG. 2*a* illustrating an open system wherein the heat transfer fluid is air and the heat sink is the environment.

As shown in FIG. 2*c*, air from a refrigerated space (i.e. thermal load 16) is circulated over regenerative bed 12 during the compression stroke to accept heat from tubes 26. Air leaving the hot end of bed 12 is deposited into the surrounding environment (i.e. heat sink 20). Conversely, during the expansion stroke, fresh room temperature air is drawn into regenerative bed 12 where it deposits heat to tubes 26. The cooled air leaving the cold end of bed 12 is blown into the refrigerated space to provide cooling. Optionally, the mechanism for compressing the working fluid 24 may also be incorporated to move heat transfer fluid 10 (i.e. to blow air across the surface of each regenerative bed 12 as described above).

Figure 3:
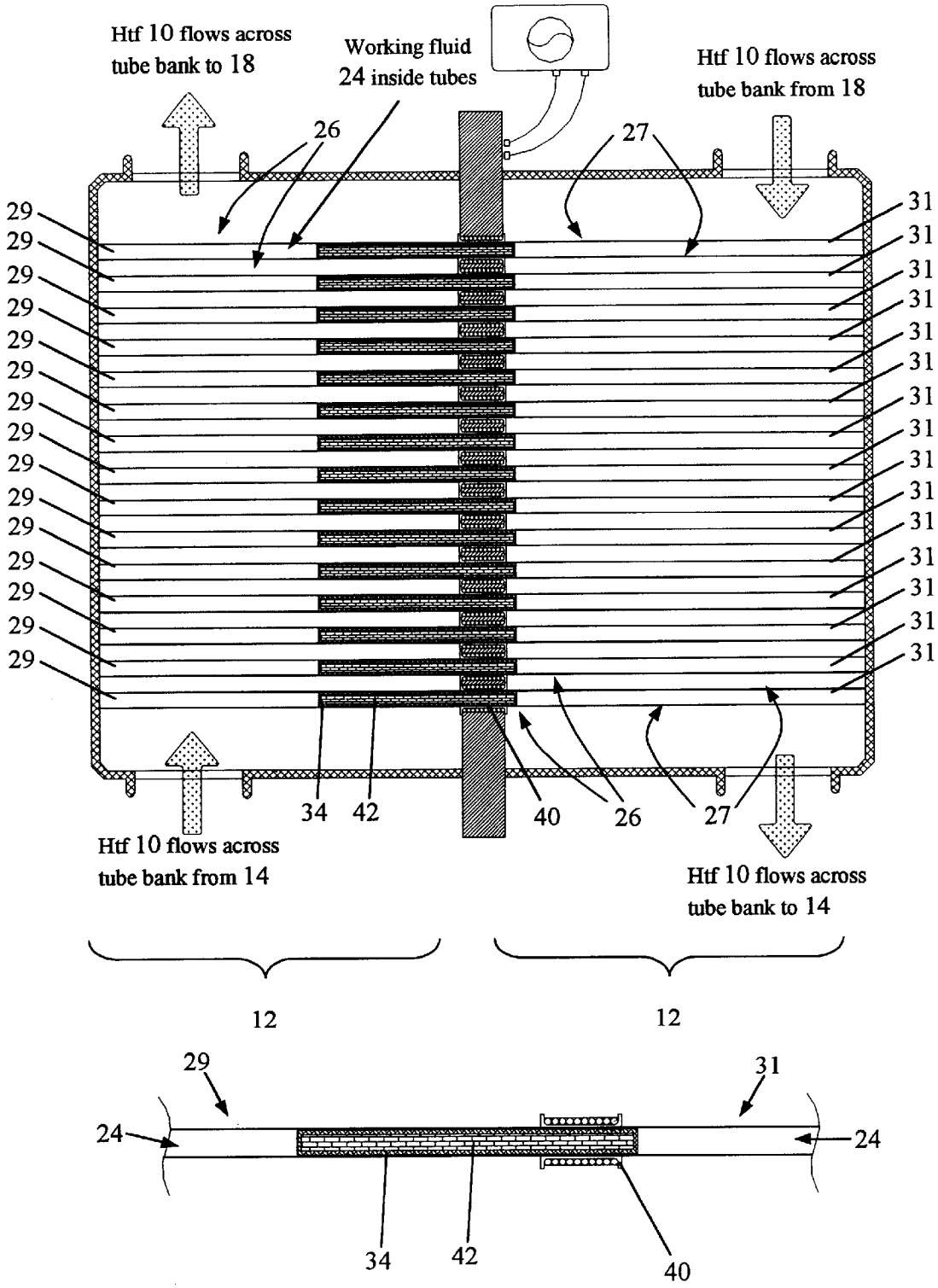
FIG. 3 is a side view of a second embodiment of the invention comprising an array of fixed volume regenerator tubes each containing a reciprocating piston.

FIG. 3 illustrates an alternative embodiment of the invention which functions in a manner similar to the embodiment of FIG. 2 but employs a different drive mechanism. As in the FIG. 2 embodiment, refrigeration elements 22 comprise an ordered array of elongate tubes 26 for containing working fluid 24. However, in this embodiment tubes 26 have a fixed volume. A shuttle 34 is mounted for reciprocal movement in each tube 26 to alternatively compress and expand working fluid 24. Each shuttle 34 divides a corresponding tube 26 into separate first and second chambers 29, 31. An annular seal surrounding each piston prevents the flow of working fluid between chambers 29, 31. As shown in FIG. 3, shuttles 34 preferably move in unison to ensure that working fluid 24 in all of the chambers 29 is compressed simultaneously while all of the fluid 24 in chambers 31 is expanded simultaneously, or vice versa. Flow of heat transfer fluid 10 relative to tubes 26 is timed to the contraction and expansion strokes as described above.

Each shuttle 34 is preferably electromagnetically driven by a drive coil 40 that operates on a magnet 42 embedded in shuttle 34. When shuttle 34 is in the central neutral position shown in FIG. 3, the pressure of working fluid is the same in chambers 29 and 31. When shuttle 34 is driven toward chamber 29, working fluid 24 in chamber 29 is compressed while fluid 24 in chamber 31 is expanded. Conversely, when shuttle 34 is driven toward chamber 31, working fluid 24 in chamber 31 is compressed while fluid 24 in chamber 29 is expanded. As indicated above, a portion of the energy stored in the compressed working fluid 24 in one chamber 29, 31 is recovered when that chamber becomes the chamber in the expanded fluid state, since the pressure differential across piston 34 helps to drive shuttle 34 toward the neutral position.

In the specific example of this embodiment illustrated in FIG. 3 shuttle 34 is approximately one half the length of tube 26 and is supported for reciprocal movement within tube 26 by notched guides (not shown). Magnet 42 may include a plurality of small permanent magnetic bars slightly spaced from one another along the central longitudinal axis of piston 34. In equilibrium, shuttle 34 is located in the central portion of tube 26 and working fluid 24 contained within chambers 29, 31 is at its mean pressure. Once drive coil(s) 40 are energized with the correct polarity to impose an attractive/repulsive driving force on shuttle 34, it reciprocates within tube 26 to alternatively compress or expand working fluid 24 in chambers 29, 31 as discussed above. The frequency of reciprocation may be controlled via a smart electronic module that drives coils 40. If the period is longer than the thermal time constant of tube 26 (i.e. fractions of a second), the changes in temperature of the tube wall 27 will not be attenuated or significantly out of phase with the drive frequency of shuttle 34.

As will be apparent to a person skilled in the art, other means for driving shuttles 34 may be employed. For example, movement of shuttles 34 may be actuated by hydraulics or any other prime moving mechanism (i.e. individual tube compressor elements connected to a larger actuated plate).

In a further alternative embodiment of the invention (not shown), shuttle 34 could comprise a simple piston or rod which is periodically inserted into a central portion of chamber 29, 31 to decrease its effective volume and increase the pressure of working fluid 24 contained therein. In this embodiment, the rod could reciprocate relative to a stationary central seal subdividing tube 26 into chambers 29, 31. One advantage of this embodiment is that working fluid 24 may remain in contact with the entire inner surface area of tube 26 during the compression and expansion cycles (and hence the surface area available for heat transfer is not reduced during the compression step). In other words, reciprocation of the rod would result in radial rather than axial compression of the working fluid.

Figure 4:
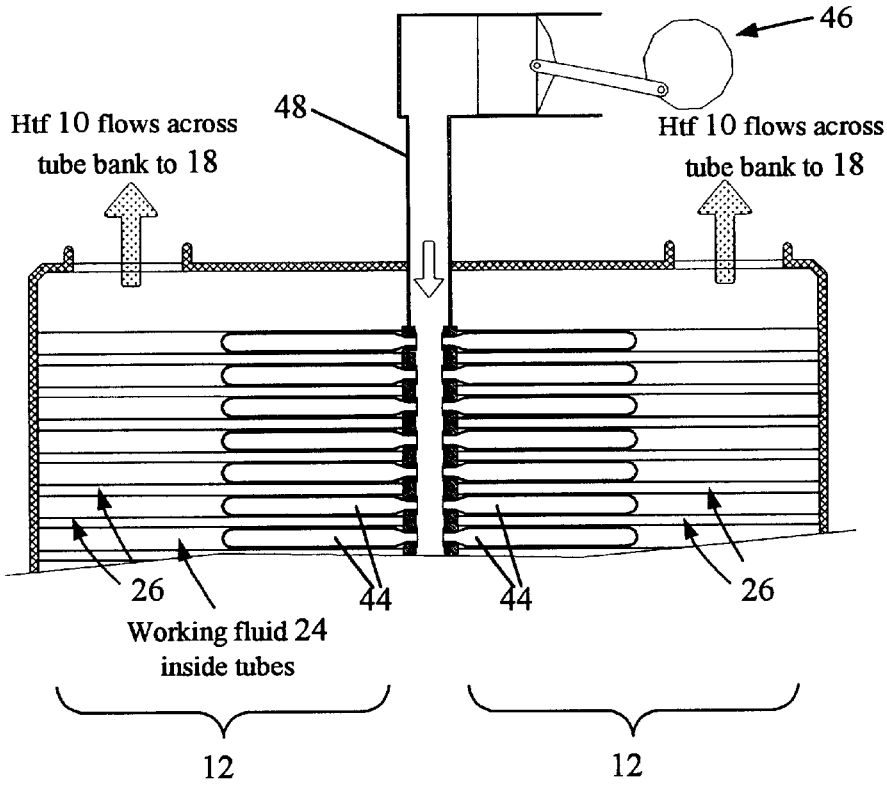
FIG. 4 is a fragmented cross-sectional view of a third embodiment of the invention comprising an array of fixed volume regenerator tubes each containing an expandable bladder connected to a common gas compressor and showing the bladders in the expanded configuration.
Figure 5:
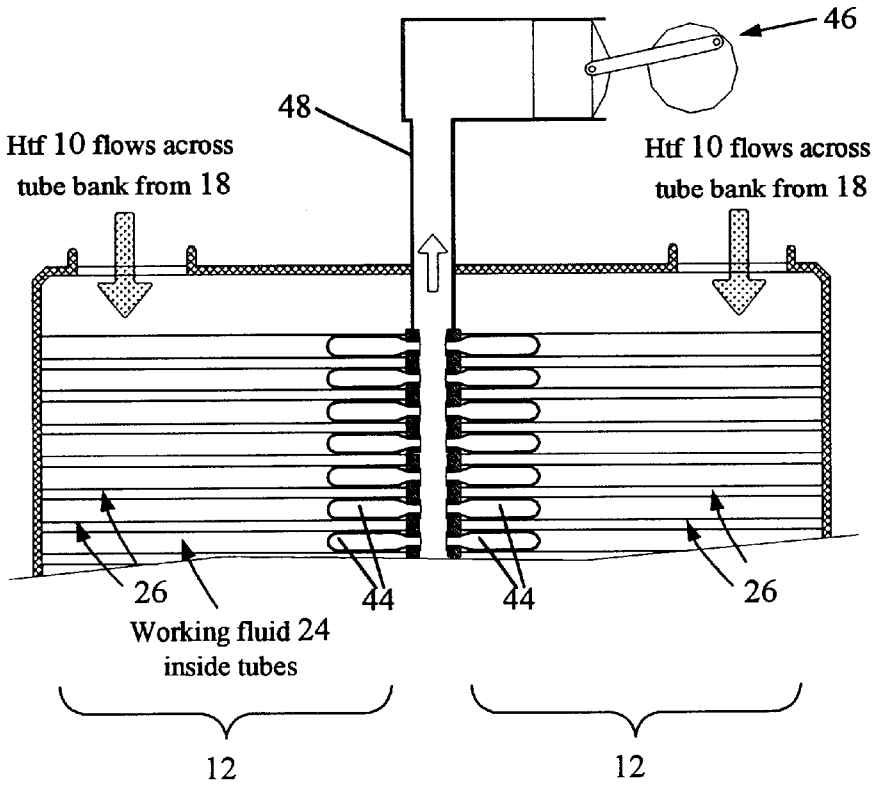
FIG. 5 is a fragmented cross-sectional view of the embodiment of FIG. 4 showing the bladders in the contracted configuration.

FIGS. 4 and 5 illustrate a further embodiment of the invention which functions in a manner similar to the embodiments of FIGS. 2 and 3 but employs an alternative drive mechanism. As in the other embodiments described above, refrigeration elements 22 comprise an ordered array of elongate tubes 26 for containing working fluid 24. The cycles of compression and expansion are enacted within tubes 26 by means of expandable bladders 44 coupled to a compressor 46. Operation of compressor 46 either forces a fluid into or withdraws a fluid from a supply conduit 48 in communication with bladders 44. During the compression stroke fluid from supply conduit 48 is forced into bladders 44 thereby causing bladders 44 to expand to a larger volume within each tube 26. This in turn causes compression of working fluid 24 contained in tubes 26 (FIG. 4). During the decompression step fluid is withdrawn from supply conduit 48 causing a contraction in the volume of bladders 44 and a consequential expansion of working fluid 24 within tubes 26 (FIG. 5). Flow of heat transfer fluid 10 relative to tubes 26 is timed to the contraction and expansion cycles as described above. The fluid in bladders 44 could be a liquid and need not be the same as working fluid 24.

Figure 6:
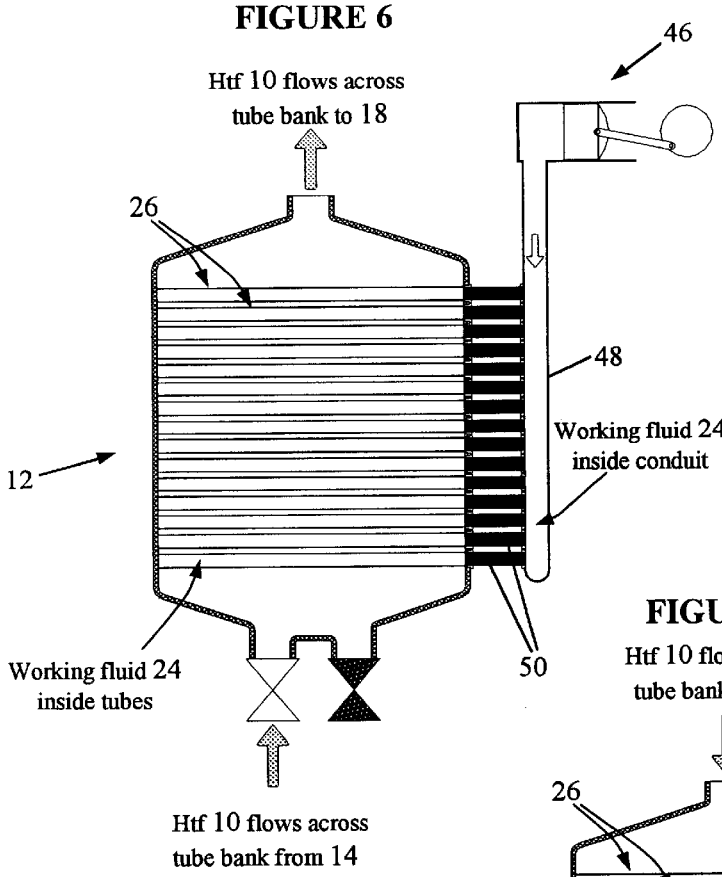
FIG. 6 is a side view of a fourth embodiment of the invention in a compressed configuration comprising an array of fixed volume regenerator tubes each coupled to a common fluid compressor with individual passive regenerators.
Figure 7:
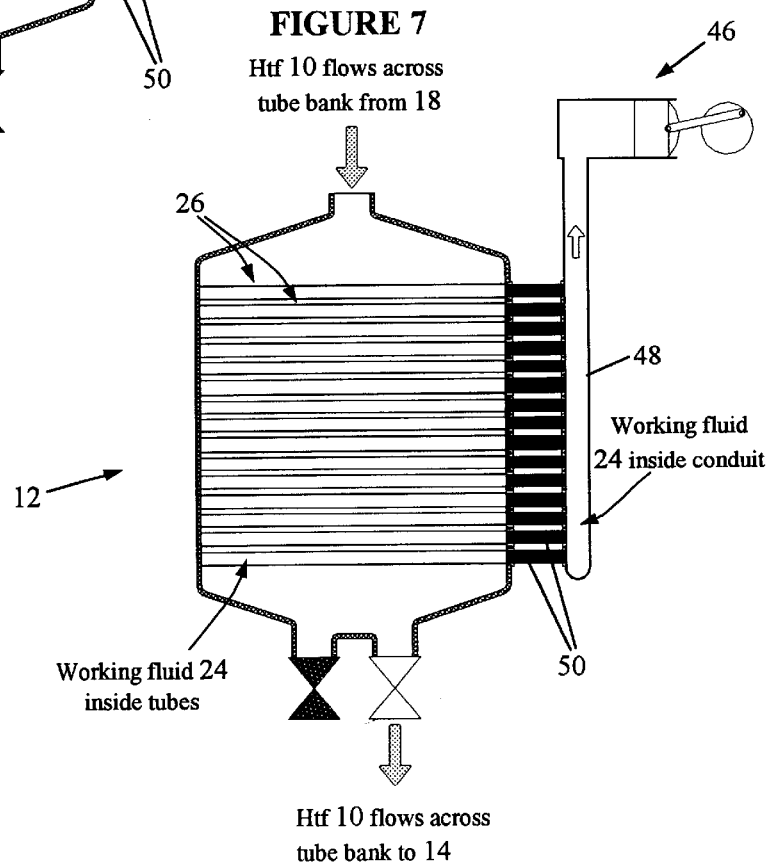
FIG. 7 is a side view of the embodiment of FIG. 6 in an expanded configuration.

FIGS. 6 and 7 illustrate a further alternative embodiment of the invention that also employs a compressor 46 which pumps fluid into or withdraws fluid from a supply conduit 48 operatively coupled to tubes 26. In this embodiment, the fluid pumped by compressor 46 is the working fluid 24 that flows into and out of tubes 26 through individual passive regenerators 50. Passive regenerators 50 are necessary in this embodiment to maintain an effective temperature gradient across regenerative bed 12. In this embodiment compressor 46 may operate at room temperature.

During the compression stroke illustrated in FIG. 6, working fluid 24 is pumped into conduit 48 and through individual passive regenerators 50 into corresponding tubes 26. Flow of working fluid 24 into each tube 26 increases the pressure of fluid 26 therein resulting in an increase in temperature of each tube 26. Passive regenerators 50 ensure that working fluid 24 in each tube 26 is thermally isolated from working fluid in supply conduit 48. More particularly, each passive regenerator 50 cools the incoming fluid 24 to approximately the mean temperature of the fluid 24 contained in the corresponding tube 26 (which will vary depending upon the location of the tube 26 in the temperature gradient spanning regenerative bed 12 as discussed above). Passive regenerators may comprise, for example, a plug of porous material having sufficient thermal mass to maintain the temperature difference between each regenerator tube 26 and supply conduit 48.

During the decompression step illustrated in FIG. 7, compressor 46 expands working fluid 24 in conduit 48 causing net flow of working fluid 24 from tubes 26 into conduit 48 through passive regenerators 50. This results in expansion of working fluid 24 within tubes 26, resulting in a decrease in the temperature thereof. As in the previously described embodiments of the invention, flow of heat transfer fluid 10 relative to tubes 26 is timed to the alternating contraction and expansion strokes.

Figure 8:
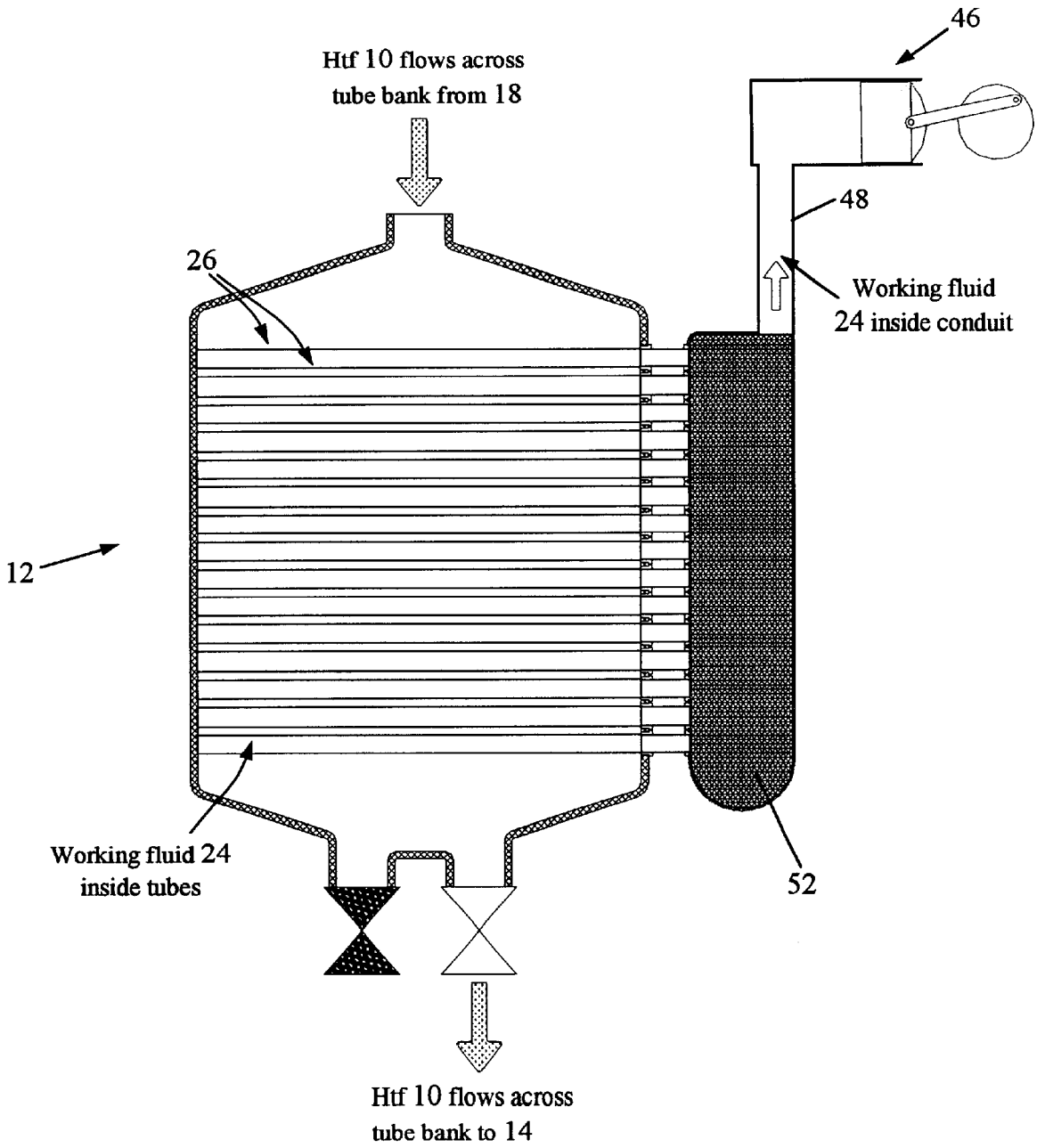
FIG. 8 is a fifth embodiment of the invention similar to the embodiment of FIGS. 6 and 7 except that each regenerator tube is coupled to the gas compressor by means of a common passive regenerator.

FIG. 8 illustrates a further alternative embodiment of the invention which also employs a common compressor 46 for pumping working fluid 24. In this embodiment compressor 46 is operatively coupled to tubes 26 by means of a common regenerator 52 rather than a plurality of individual passive regenerators 50. In order to maintain the temperature gradient across regenerative bed 12, common regenerator 52 must exhibit a similar temperature gradient. Common regenerator 52 may be specifically sized or tapered to account for reduced mass flow rates required along its length (i.e. from hot end to cold end).

During the compression portion of the refrigeration cycle, working fluid 24 is forced by compressor 46 into common regenerator 52. Working fluid 24 is cooled along the length of regenerator 52 to approximately the temperature of each tube 26 in communication with the corresponding portion of regenerator 52. Accordingly, working fluid 24 flows from regenerator 52 into each tube 26 at approximately the mean temperature of the respective tube 26. The net inflow of working fluid 24 causes compression of working fluid 24 and hence an increase in temperature of tubes 26. Flow of working fluid 24 is reversed during the expansion portion of the refrigeration cycle, causing fluid 24 to flow into regenerator 52 along its length at different temperatures to maintain the temperature gradient.

One advantage of the FIG. 8 design over the embodiment of FIGS. 6 and 7 is that only a single regenerator 52 is required to operatively couple compressor 46 to regenerative bed 12 rather than a plurality of individual regenerators 50. This reduces the complexity of the apparatus and may result in lower manufacturing costs.

Figure 9A:
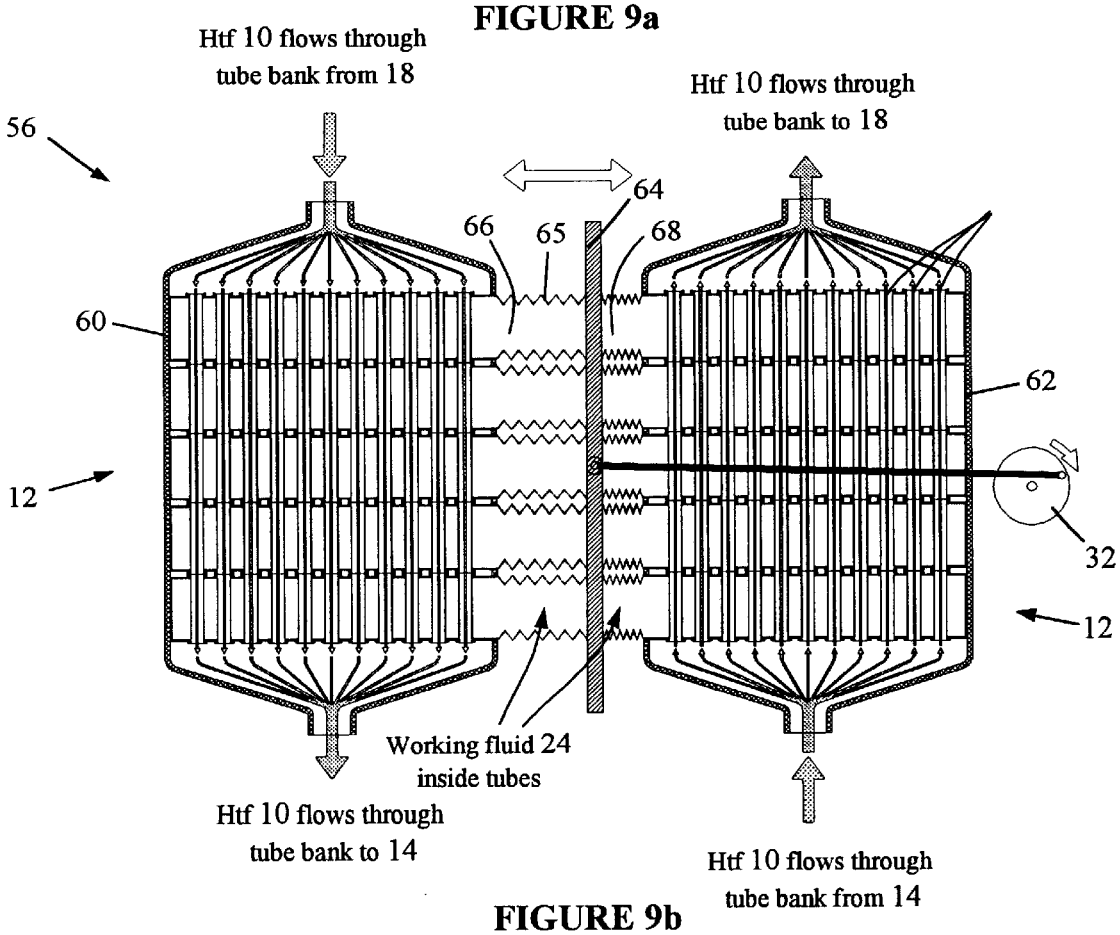
FIG. 9*a* is a cross-sectional view of a sixth embodiment of the invention comprising a vessel having a plurality of compartments for containing working fluid external to heat transfer delivery tubes extending therethrough.
Figure 9B:
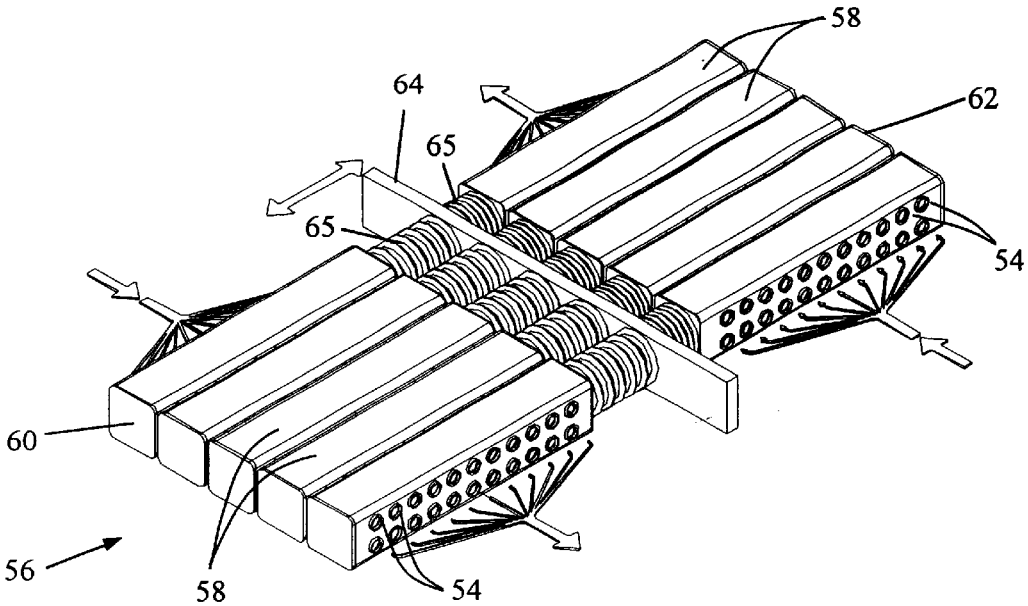
FIG. 9*b* is a partial isometric view of the embodiment of FIG. 9*a*.

FIGS. 9*a* and 9*b* illustrate a further alternative embodiment of the invention wherein working fluid 24 is external to the conduits containing heat transfer fluid 10 rather than vice versa. For example, heat transfer fluid may be circulated through a plurality of parallel tubes 54 surrounded by working fluid 24 contained within a vessel 56.

In the FIGS. 9*a*/9*b* embodiment, each refrigeration element 22 comprises a separate compartment 58 of vessel 56 through which tubes 54 extend. As in other embodiments of the invention described above, heat transfer fluid 10 and working fluid 24 are physically separated. A plurality of compartments 58 are preferably provided to maintain an effective temperature gradient within vessel 56. Division of vessel 56 into multiple compartments 58 is a function of desired efficiency and may be modified.

As in some previously described embodiments of the invention, vessel 56 is a dual compressor and expander enabling work recovery. Parallel regenerative beds 12 are located at opposite ends 60 and 62 of vessel 56. Work is inputted into the cycle by reciprocation of a moveable wall 64 coupled to a flexible central wall portion 65 of vessel 56 or some other suitable compression means such as synchronized dual acting pistons mounted for movement within compartments 58. Wall 64 divides each compartment 58 into a first chamber 66 and a second chamber 68 (FIG. 9*a*). In the illustrated embodiment, wall 64 is displaced toward end 62 of vessel 56 resulting in expansion of working fluid 24 within chambers 66 and compression of working fluid 24 within chambers 68. Heat transfer fluid 10 is circulated through tubes 54 at vessel end 60 from hot exchanger 18 to cold heat exchanger 14; and simultaneously through tubes 54 at vessel end 62 from cold heat exchanger 14 to hot heat exchanger 18. When wall 64 is displaced in the opposite direction toward vessel end 60, the flow of heat transfer fluid 10 is reversed.

The FIGS. 9*a*/9*b* embodiment of the invention has several inherent advantages. Compartments 58 may be much larger in volume than elongate tubes 26 employed in alternative embodiments of the invention described above. This permits much larger volumes of working fluid 24 to be simultaneously compressed while avoiding the inefficiencies of the "pulse tube effect". When compressing the working fluid 24 using a common compressor through passive regenerators 50, such as shown in FIGS. 6, 7 and 8, each tube 26 will exhibit a temperature gradient along its longitudinal length. This pulse tube effect is due to the fact that the fluid entering each tube 26 through the passive regenerator does so at a relatively common temperature due to the large thermal mass of passive regenerators 50. The first portion of fluid entering tube 26 during the first part of compression stroke of the cycle is compressed by the next portion of fluid entering tube 26, which is compressed by the next portion of fluid and so on. Therefore the first portion of fluid entering tube 26 is subsequently compressed and displaced towards the closed end of tube 26. This portion of fluid will also experience the highest temperature change. The last portion of fluid entering tube 26 at the end of the compression stroke will have the lowest temperature change and will be only slightly higher in temperature than the end of the passive regenerator. Therefore a temperature gradient will form along the length of each tube 26, with the highest temperature at the closed end of tube 26 and the lowest temperature at the open end of tube 26 near the passive regenerator.

Further, since the working fluid 24 is compressed externally to the heat transfer fluid 10, it is not necessary to use tubes having very thin walls. Rather, regular thin-walled tubes 54 may be employed. Since the working fluid of this embodiment is not confined to the internal volume of tubes 26, a larger volume of working fluid 24 may be employed thereby increasing the thermal mass ratio of working fluid 24 to heat transfer fluid 10 and the wall material of tubes 54. The heat transfer coefficient between tubes 54 and working fluid 24 may be further increased by incorporating flow elements that direct working fluid 24 across the banks of tubes 54 during compression and expansion.

Figure 10A:
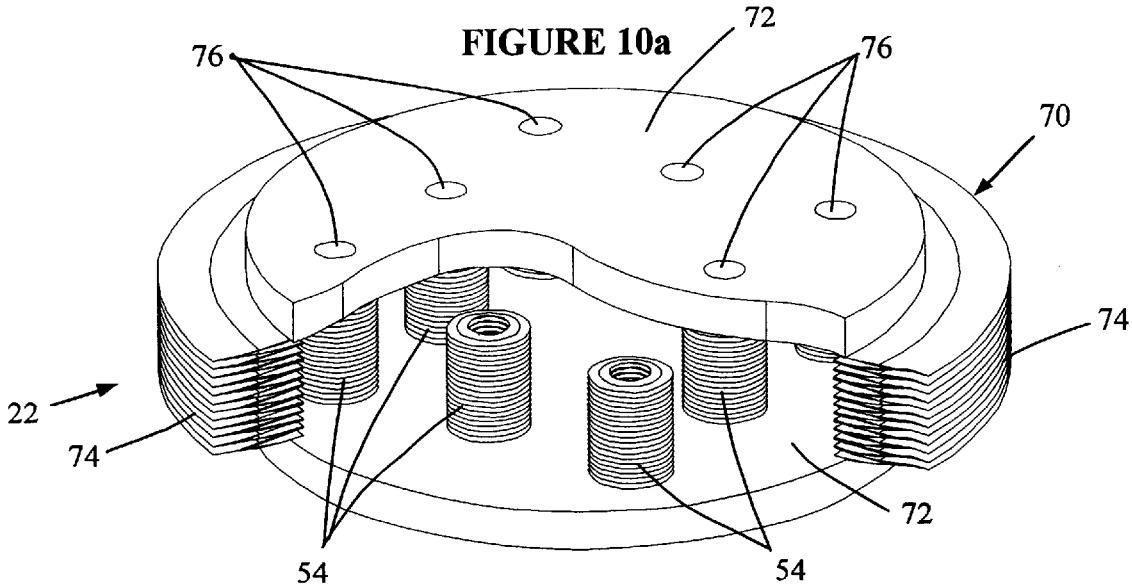
FIG. 10*a* is an isometric, partially cut-away view of a seventh embodiment of the invention comprising a modular refrigeration element having a plurality of heat transfer tubes extending therethrough and showing the refrigeration element in a compressed configuration.
Figure 10B:
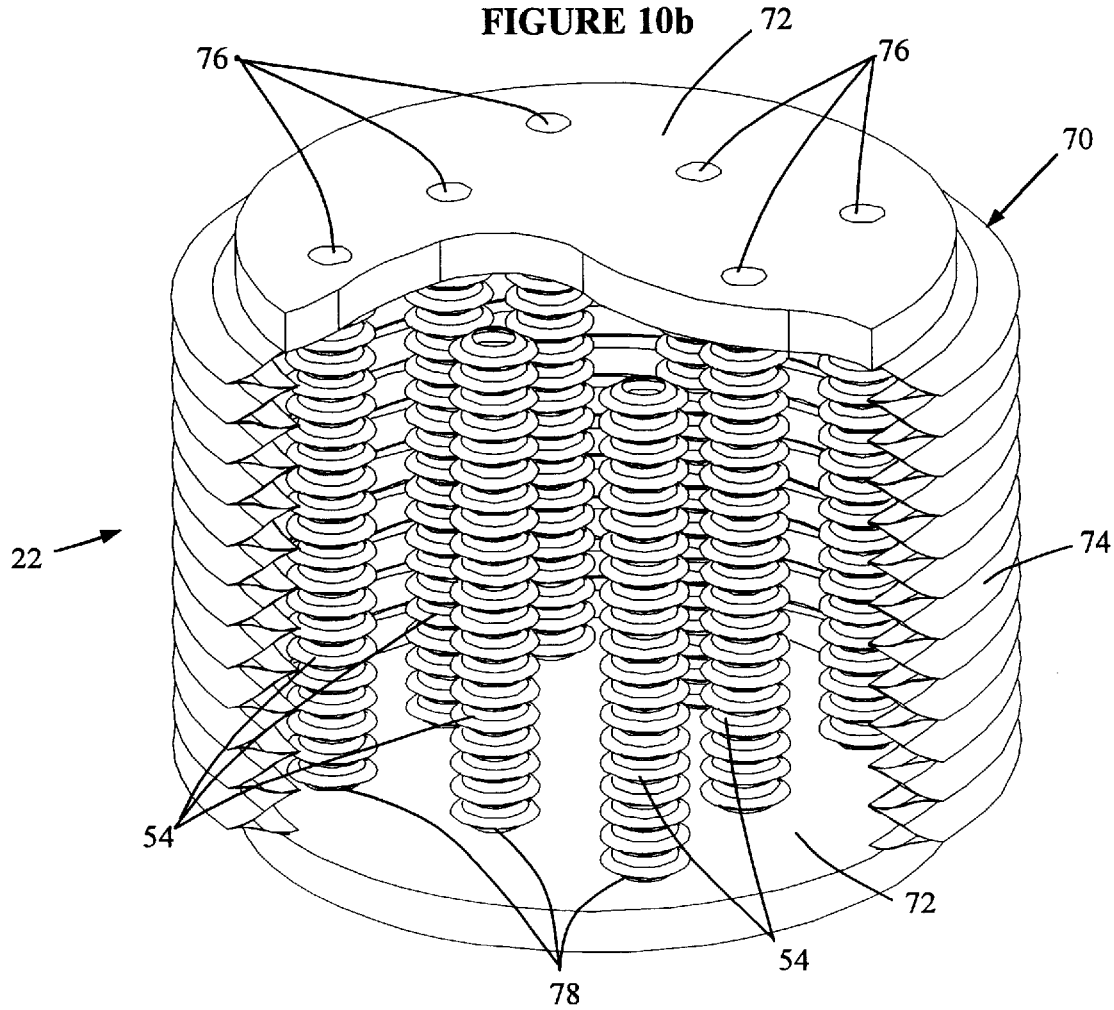
FIG. 10*b* is an isometric, partially cut-away view of the modular refrigeration element of FIG. 10*a* in an expanded configuration.

FIGS. 10*a* and 10*b* illustrate a further alternative embodiment of the invention which is a variation of the embodiment of FIG. 9 (i.e. working fluid 24 is compressed and expanded externally of heat transfer fluid 10). In this embodiment refrigeration element 22 comprises a vessel 70 having annular end plates 72 and a gusseted sidewall 74 which is expandable and compressible in an accordion-like fashion to compress or expand working fluid 24 contained therein. End plates 72 are preferably formed from a thermally non-conductive material so that each element 22 operates at a discrete temperature as discussed further below. Heat transfer fluid 10 flows within vessel 70 through at least one heat transfer tube 54. In the illustrated embodiment a plurality of heat transfer tubes 54 extending between end plates 72 are shown. Tubes 54 also have flexible gusseted sidewalls to enable compression and expansion of tubes 54 as vessel 70 expands and contracts. Each tube 54 has an inlet 76 on one end plate 72 and an outlet 78 on the other end plate 72. Preferably a plurality of parallel tubes 54 are provided to maximize the surface available for heat transfer. Vessel 70 has a variable internal volume and is adjustable between a compressed configuration (FIG. 10*a*) and an expanded configuration (FIG. 10*b*).

Figure 11A:
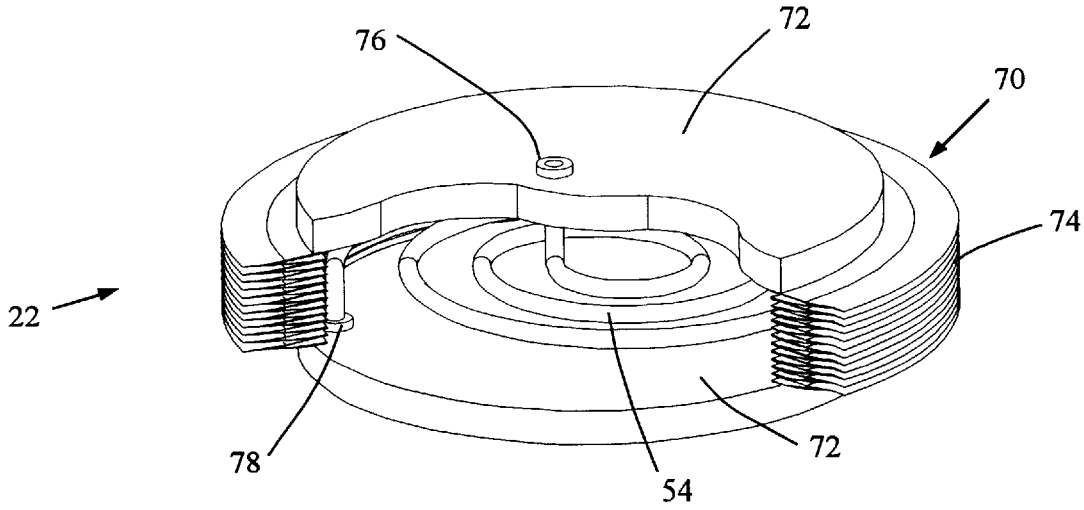
FIG. 11*a* is an isometric, partially cut-away view of an eighth embodiment of the invention comprising a modular refrigeration element in a compressed configuration similar to the embodiment of FIG. 10*a* but having a spiral heat transfer tube wound within the interior thereof.
Figure 11B:
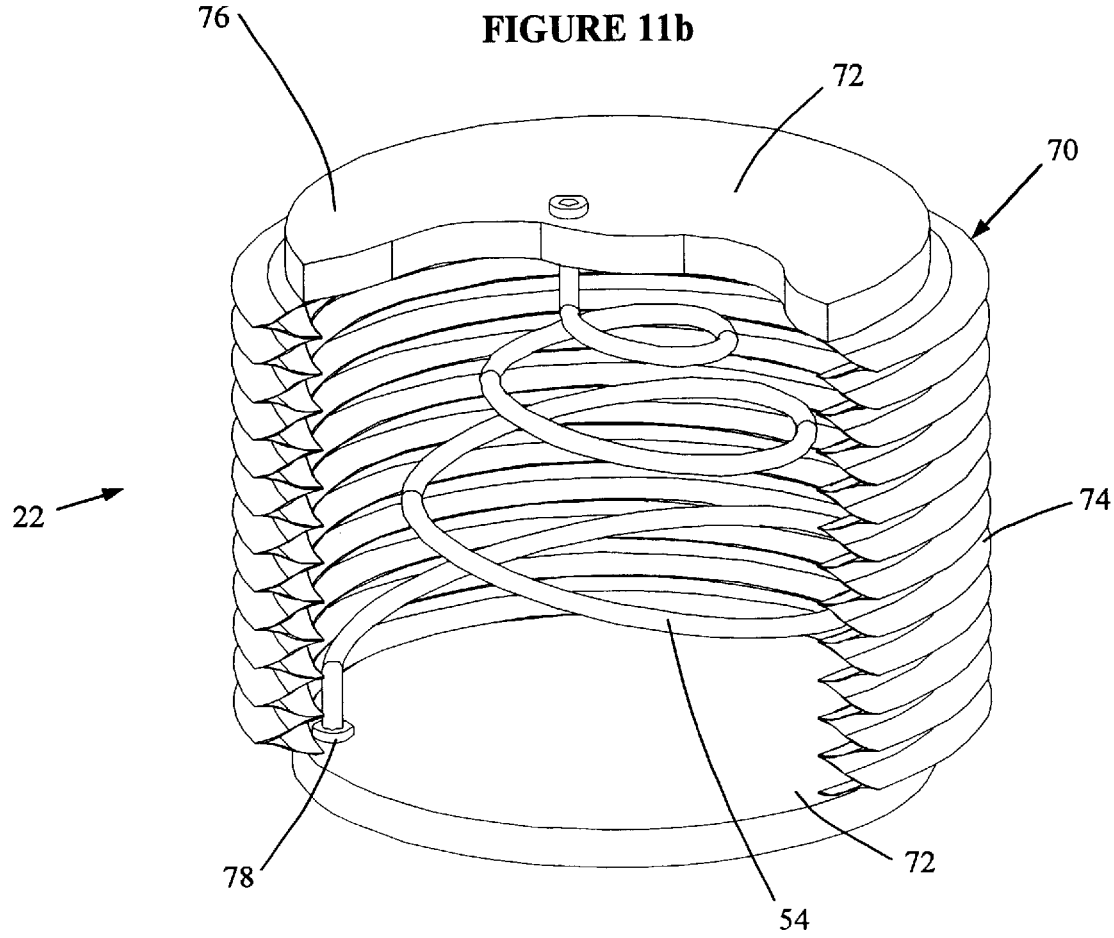
FIG. 11*b* is an isometric, partially cut-away view of the modular refrigeration element of FIG. 11*a* in an expanded configuration.

FIGS. 11*a* and 11*b* illustrate a further alternative embodiment of the invention. This embodiment is similar to the embodiment of FIGS. 10*a* and 10*b* except that only a single heat transfer tube 54 is provided which is wound in a spiral configuration within vessel 70. As in the FIG. 10 embodiment, heat transfer tube 54 is compressible and expandable and includes an inlet 76 on one end plate 72 and an outlet 78 on the other end plate 72. As a result of its spiral configuration, the heat transfer tube 54 of FIG. 11 has a relatively large surface available for heat transfer in both the compressed (FIG. 11*a*) and expanded (FIG. 11*b*) configurations. Accordingly, only one tube 54 per refrigeration element 22 may be required.

Figure 12A:
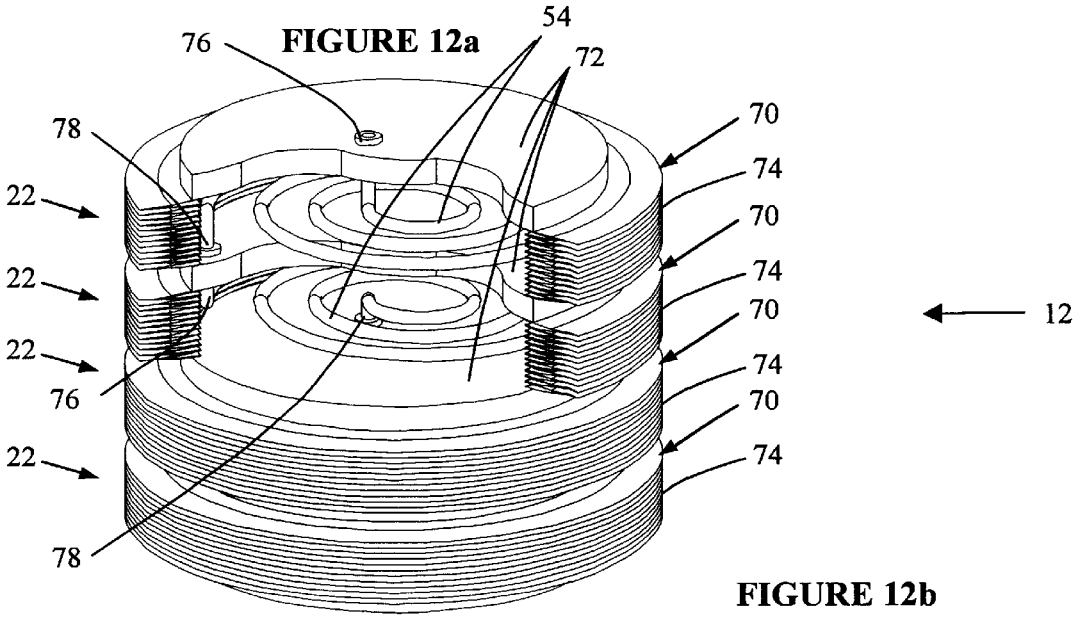
FIG. 12*a* is an isometric, partially cut-away view of a regenerative bed comprising a plurality of the modular refrigeration elements of FIG. 11*a* arranged in a stack and shown in the compressed configuration.
Figure 12B:
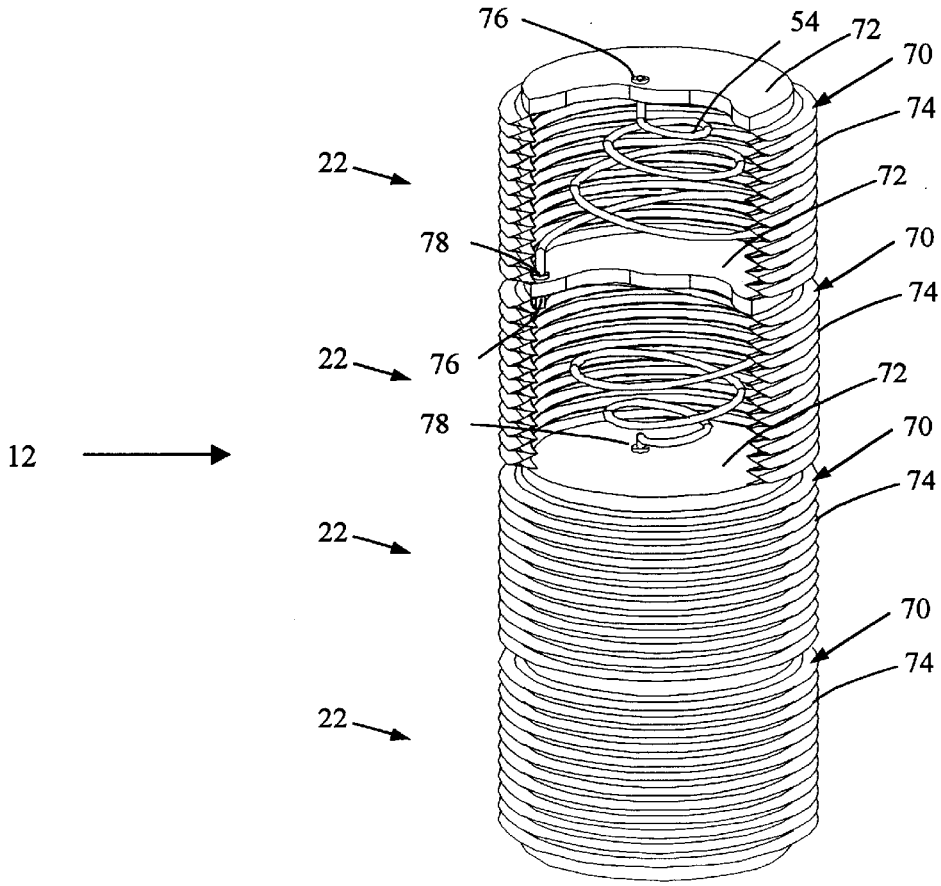
FIG. 12*b* is an isometric, partially cut-away view of the regenerative bed of FIG. 12*a* showing the modular refrigeration elements in an expanded configuration.

FIGS. 12*a* and 12*b* illustrate a plurality of refrigeration elements 22 stacked on top of one another to form a regenerative bed or module 12. For example, elements 22 may be operatively coupled together between cold heat exchanger 14 and hot heat exchanger 18 (not shown in FIGS. 12*a* and 12*b*). The heat transfer tubes 54 of adjacent refrigeration elements 22 are connected together to enable flow of heat transfer fluid 10 through the entire regenerative bed 12. In particular, an outlet 78 of one element 22 is connected to an inlet 76 of the next-in-series element 22. Working fluid 24 in each refrigeration element 22 in the stack is thermally isolated from working fluid 24 in an adjacent element 22 by end plates 72 to enable the establishment of a temperature gradient across bed 12. As explained above, refrigeration elements 22 are thermally coupled by connecting the heat transfer fluid outlet 78 of one element 22 to an inlet 76 of the next-in-series element 22. The first and last elements 22 in the array could be thermally coupled to heat exchangers 14, 18 as in the embodiments described above.

FIG. 12*a* illustrates a stack of refrigeration elements 22 in a compressed configuration and FIG. 12*b* show the stack of refrigeration elements 22 in an expanded configuration. As discussed above, the flow direction of heat transfer fluid 10 through heat transfer tubes 54 within regenerative bed 12 preferably alternates with compression and expansion strokes.

The embodiments of FIGS. 10–12 exhibit the advantages of a modular design. The number of refrigeration elements 22 may vary depending upon the refrigeration specifications (i.e. the temperature gradient) required. Each refrigeration element 22 preferably operates at a discrete mean temperature within the temperature gradient (i.e. corresponding to a separate regenerator tube 26 of the FIGS. 2–8 embodiments or a separate vessel compartment 58 of the FIG. 9 embodiment, each tube or compartment operating at a designated temperature). Each refrigeration element 22 could be tailored to operate optimally at its designated temperature, such as by selecting a working fluid 24 near its critical point at the designated temperature.

Figure 13:
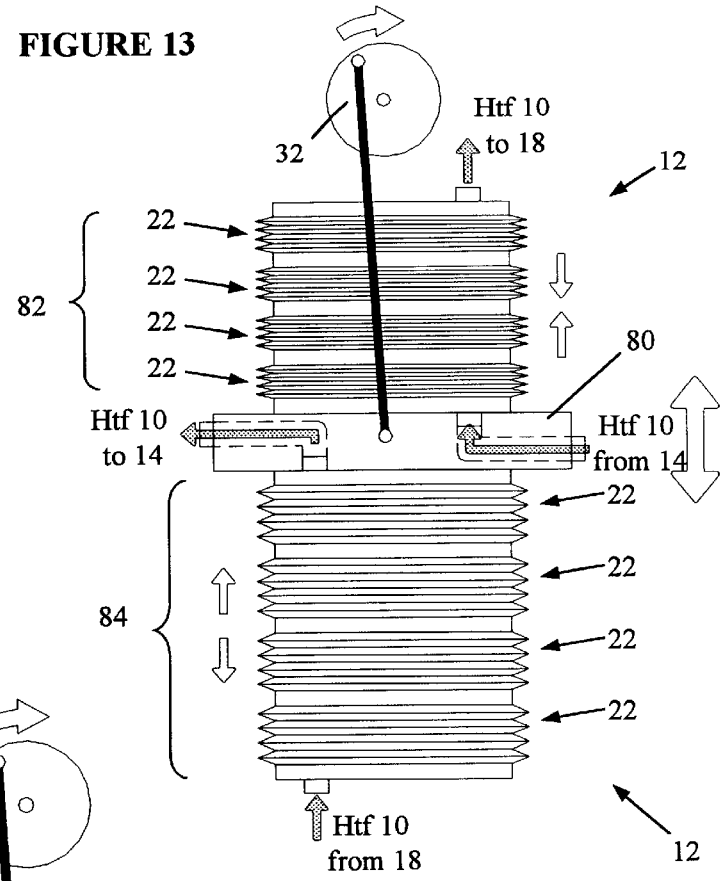
FIG. 13 is a side view of dual regenerative beds of FIGS. 12*a*/12*b* coupled together by an axially displaceable piston to enable work recovery.
Figure 14:
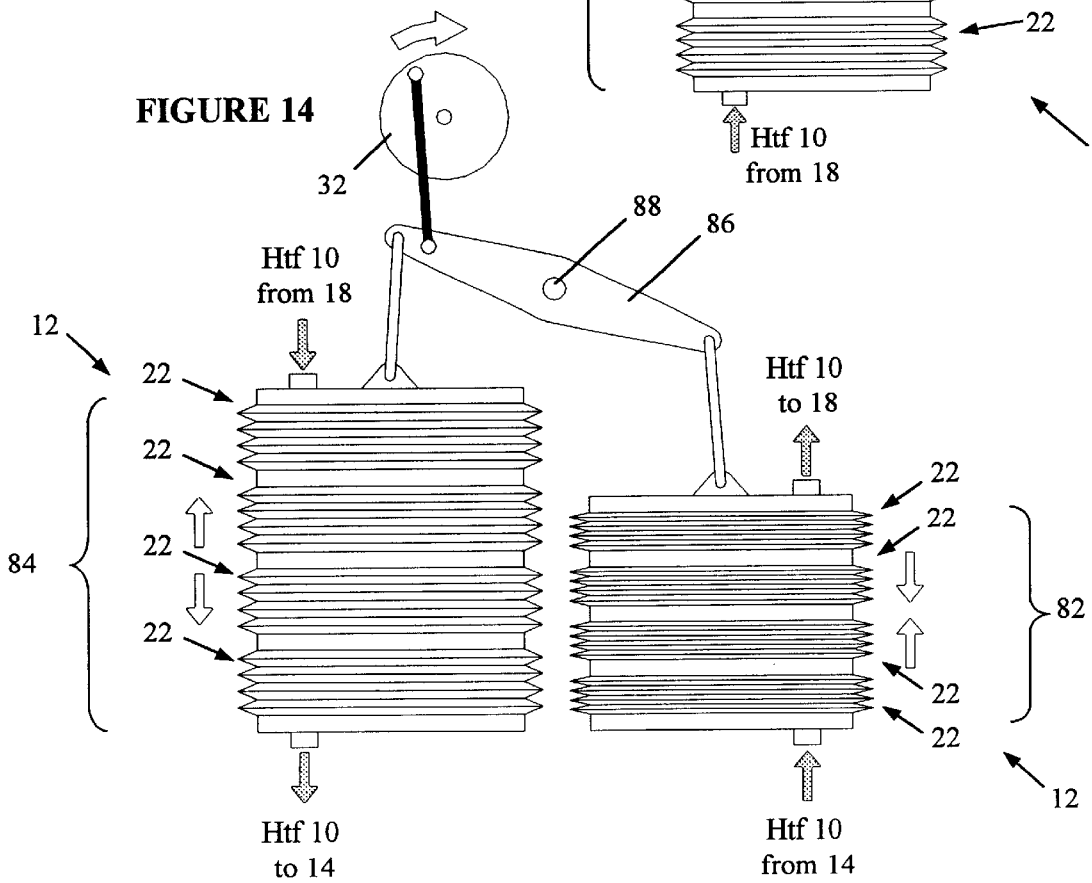
FIG. 14 is a side view of dual regenerative beds of FIGS. 12*a*/12*b* coupled together by a pivoting rocker arm to enable work recovery.

FIGS. 13 and 14 illustrate a plurality of refrigeration elements 22 arranged in dual regenerative beds 12 that are operatively coupled together. In particular, beds 12 are expanded and contracted in tandem to enable work recovery. In the embodiment of FIG. 13, an axially displaceable piston 80 reciprocates back and forth to provide the work input. During a first stroke of piston 80 a first group 82 of refrigeration elements 22 will be compressed and a second group 84 of refrigeration elements 22 will be simultaneously expanded. During the second stroke of piston 70 the first group 82 will be expanded and the second group 84 will be compressed. In each case the working fluid 24 contained within each refrigeration element 22 will change in temperature, thereby causing transfer of heat to, or acceptance of heat from, heat transfer fluid 10 circulated through tubes 54.

In the embodiment of FIG. 14 a rocker arm 86 pivots about an axis 88 to alternatively compress and expand dual regenerative beds 12 to enable work recovery in a similar manner to the embodiment of FIG. 13.

Figure 15:
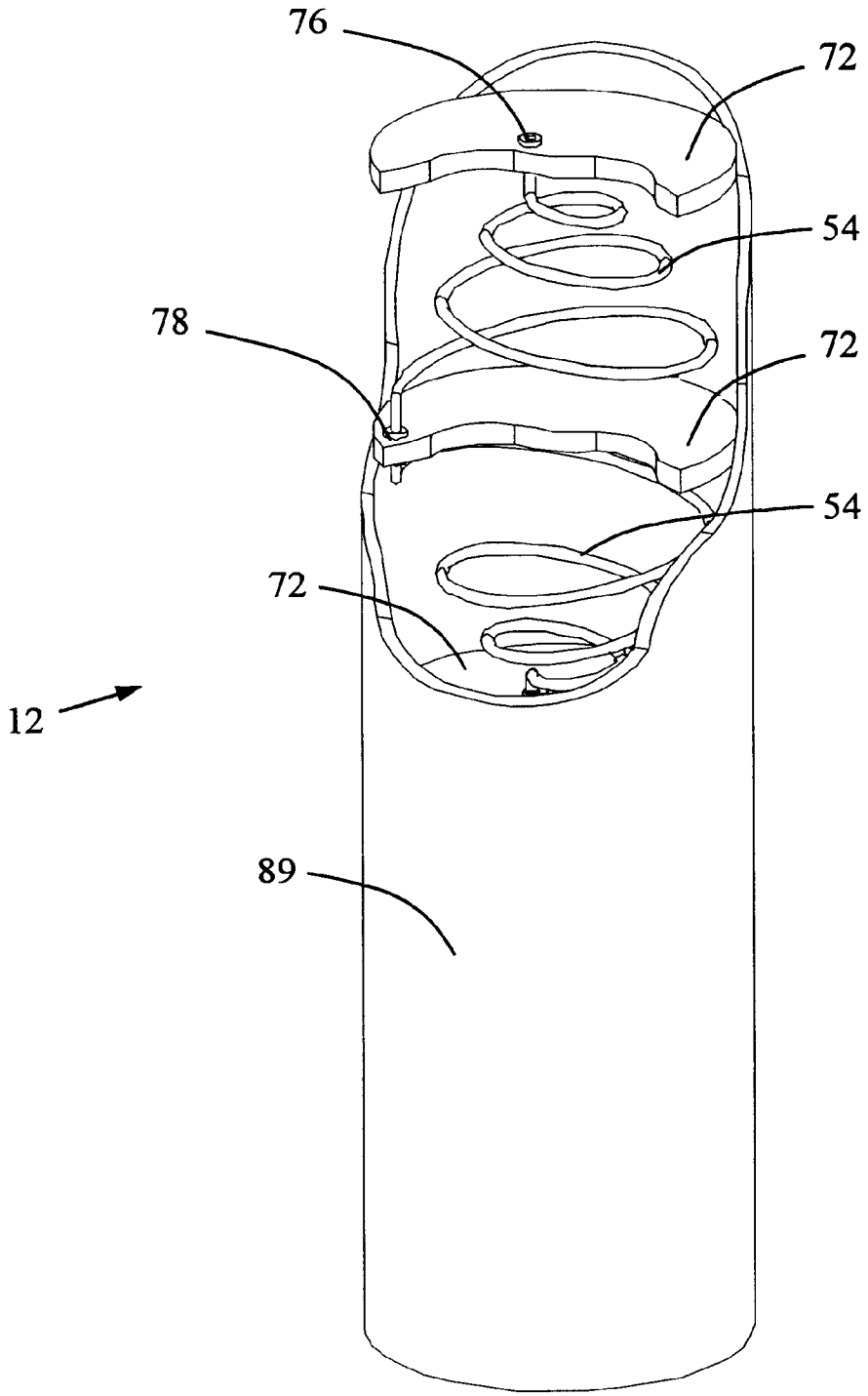
FIG. 15 is an isometric, partially cut-away view of a ninth embodiment of the invention illustrating a regenerative bed similar to the embodiment of FIG. 12*b* but having a common sidewall.

FIG. 15 illustrates a further alternative embodiment of the invention wherein regenerative bed 12 comprises a common, unitary sidewall 89 rather than a gusseted or bellows-type sidewall. In the embodiment of FIG. 15, refrigeration elements 22 are separated and thermally isolated by end plates 72. Plates 72 are sealed and moveable relative to common sidewall 89 to vary the volume of elements 22, thereby compressing or expanding working fluid 24 contained therein. As in the embodiment of FIGS. 11*a* and 11*b*, a heat transfer tube 54 is wound within the interior of each individual refrigeration element 22. Refrigeration elements 22 are thermally coupled by connecting the heat transfer fluid outlet 78 of one element 22 to an inlet 76 of the next-in-series element 22 as described above.

Figure 16A:
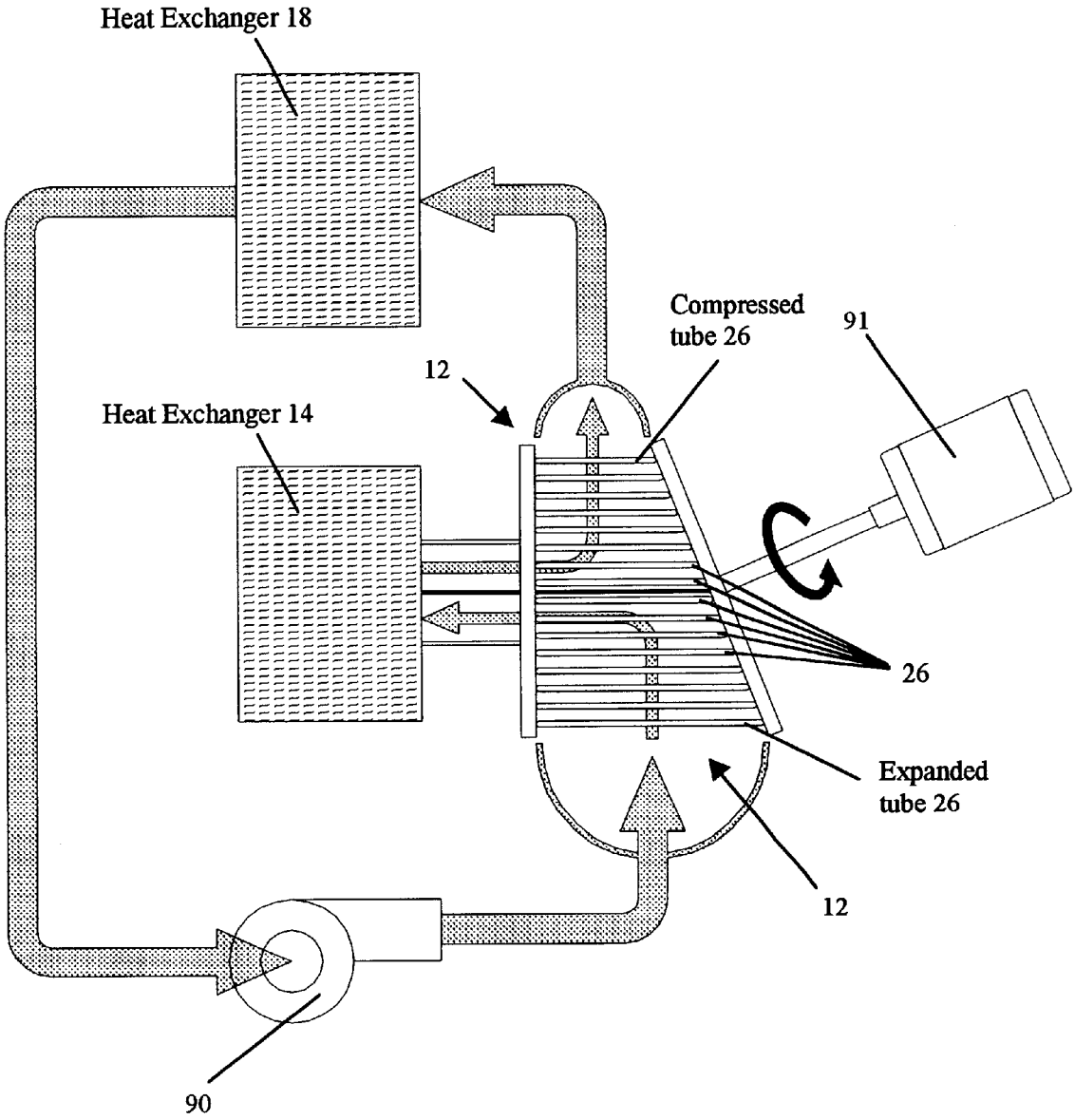
FIG. 16*a* is a schematic view of a tenth embodiment of the invention wherein the regenerator tubes are rotatable to alternatively contract and expand the working fluid.

FIG. 16*a* illustrates a further alternative embodiment of the invention which relies on rotary rather than reciprocal movement to effect compression and expansion cycles, but otherwise shares the same functional principles as the embodiments described above. Heat transfer fluid 10 moves in a continuous fashion through the heat transfer loop. In particular, fluid 10 from hot heat exchanger 18 is pumped into the cold end of regenerative bed 12 by means of blower 90. The cold part of bed 12 (i.e. where heat transfer fluid 10 flows radially inward) comprises a plurality of elongated tubes 26 each containing expanded working fluid 24. After depositing heat to elongated tubes 26, the cooled heat transfer fluid 10 enters cold heat exchanger 14 to cool the thermal load and provide the refrigeration effect. Heat transfer fluid 10 is discharged from cold heat exchanger 14 into the hot part of regenerative bed 12 comprising contracted tubes 26 containing compressed working fluid 24. Here heat transfer fluid 10 accepts heat from tubes 26 as it flows radially outward. The outwardly flowing heat transfer fluid 10 transfers the heat to hot heat exchanger 18 to complete the cycle. Heat transfer fluid 10 may be conveyed in either a closed cycle or an open cycle using room temperature air as described above.

Work is inputted into the system by means of a motor 91 driving the rotary movement. Rotation of regenerative bed 12 causes alternative extension and contraction of tubes 26, and consequential expansion and contraction of working fluid 24, depending upon the arc of rotation. As will be apparent to a person skilled in the art, rotary devices have the potential for higher frequency operation than reciprocating devices. This may help reduce the size of the apparatus and potentially reduce capital costs.

Figure 16B:
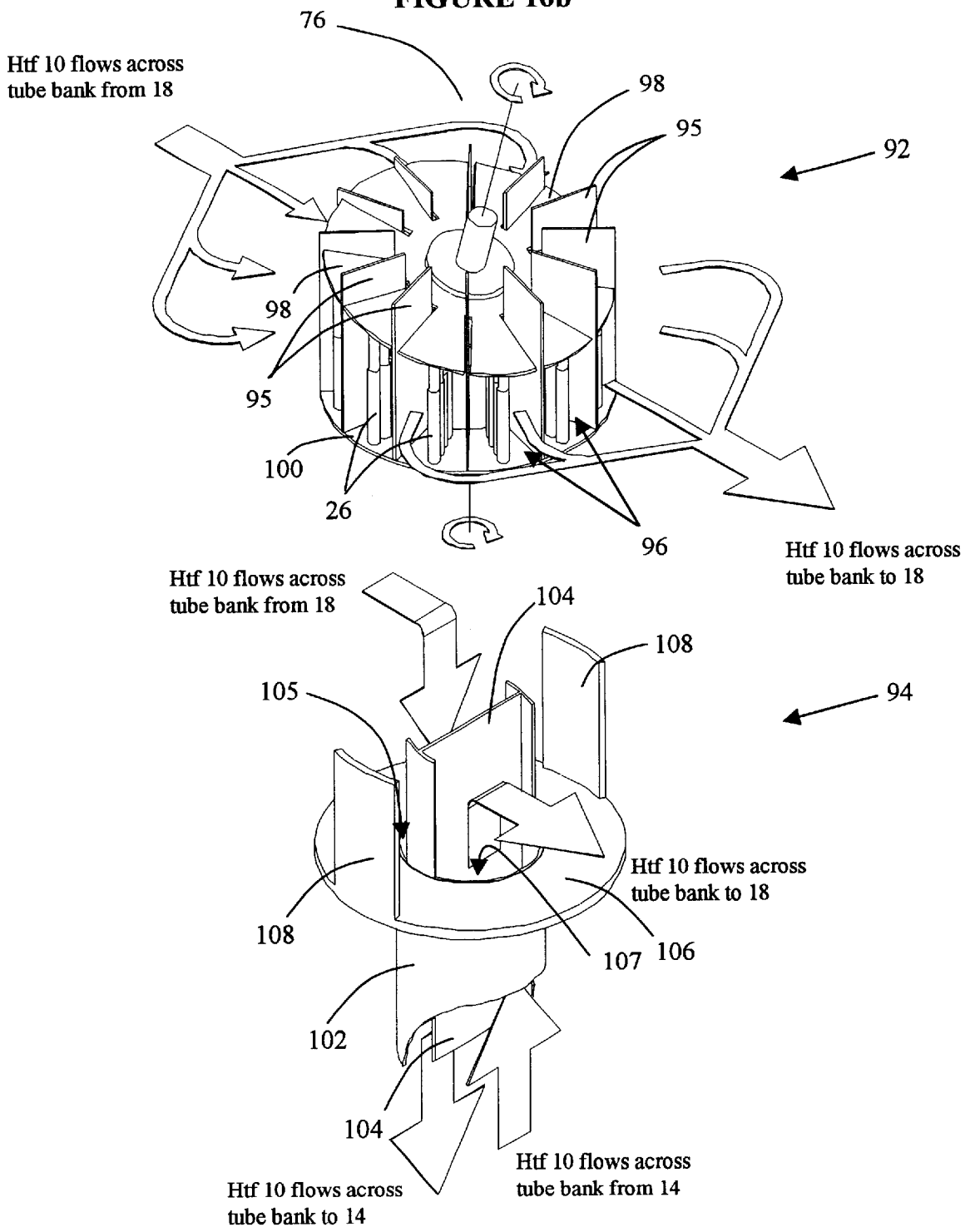
FIG. 16*b* is an exploded, isometric view of an exemplary tenth embodiment of the invention wherein the regenerator tubes are disposed on a rotatable carousel mounted on a heat transfer fluid delivery column.
Figure 16C:
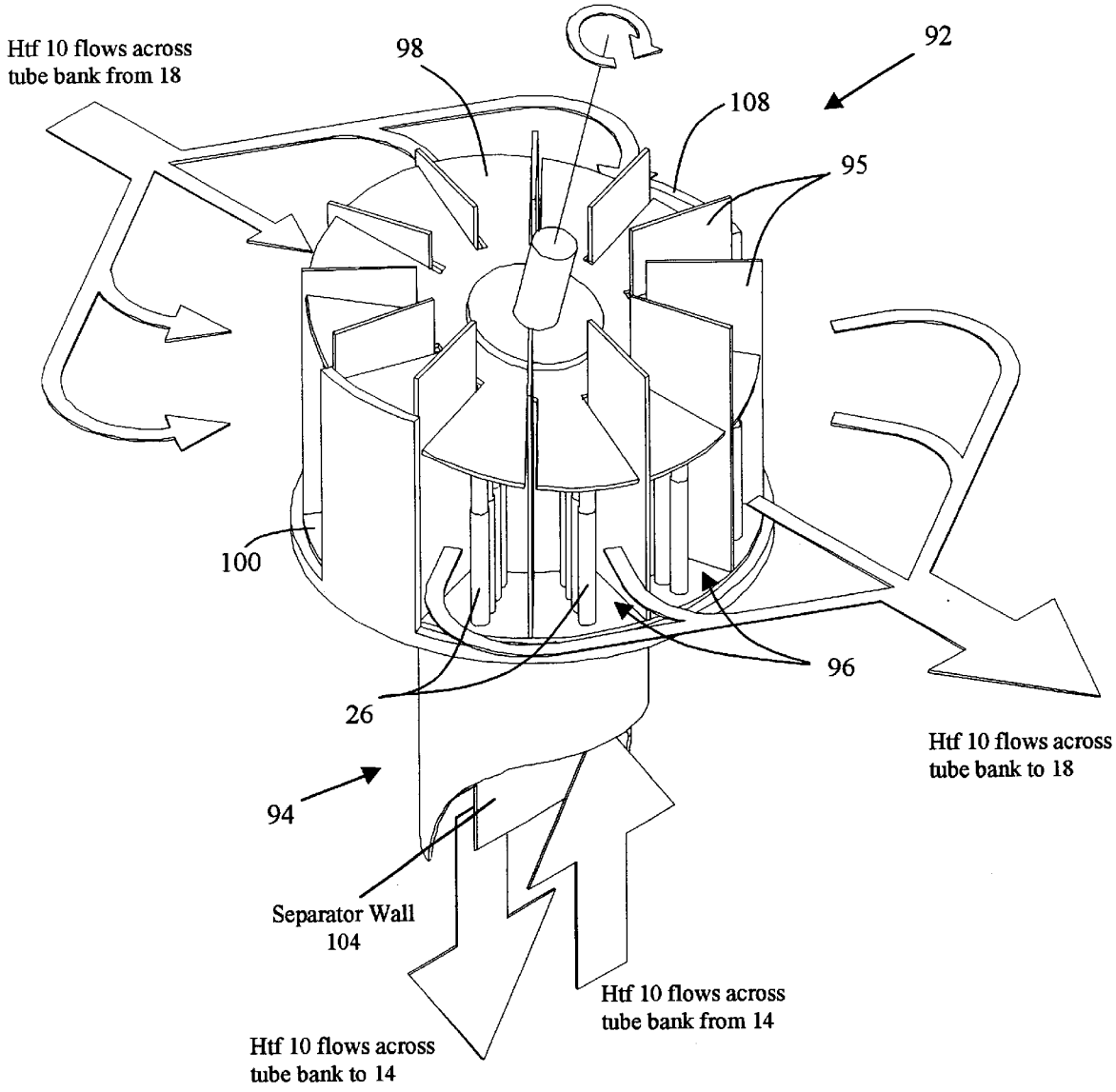
FIG. 16*c* is an isometric view of the embodiment of FIG. 16*b* in its assembled configuration.
Figure 16D:
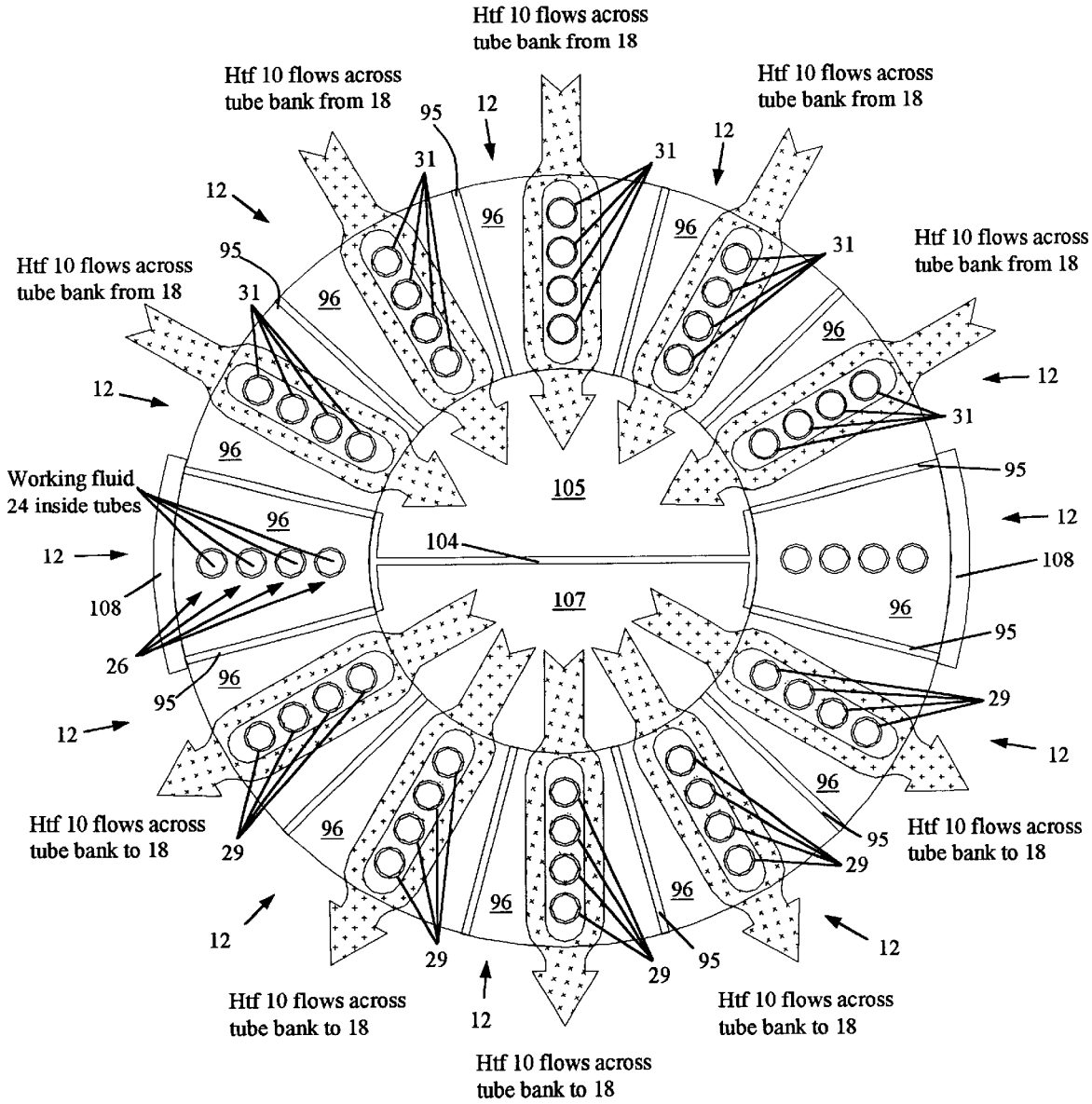
FIG. 16*d* is an enlarged, cross-sectional view of the embodiment of FIGS. 16*b* and 16*c*.

FIG. 16*b* illustrates one possible embodiment of a rotary refrigerator comprising a plurality of regenerative beds 12 to enact an active regenerative cycle. This rotary refrigerator includes a rotatable carousel 92 mounted on a column 94. Carousel 92 has a plurality of circumferentially spaced baffles 95 defining compartments 96 therebetween. Slotted upper and lower plates 98 and 100 are coupled to baffles 95 to define the upper and lower end walls of compartments 96. Upper plate 98 is disposed at an angle relative to lower plate 100 and is moveable relative to baffles 95 to vary the size of compartments 96. In particular, upper plate 98 is coupled to a shaft 109 that rotates about an axis which intersects the plane of lower plate 100 a non-perpendicular angle (FIGS. 16*b* and 16*c*). A plurality of extensible tubes 26 containing working fluid 24 extend within each compartment 96 between plates 98, 100. The length of each extensible tube 26 within a compartment 96 (and hence the temperature of the working fluid 24 contained therein) varies depending upon the radial position of such tube 26. Each compartment 96 therefore essentially constitutes a discrete regenerative bed 12 having a temperature gradient between the outside diameter and the inside diameter of carousel 92 (FIG. 16*d*)

Carousel 92 is mounted on column 94 as shown in FIGS. 16*b* and 16*c*. Column 94 consists of a fixed heat transfer fluid supply cylinder 102 sub-divided by a central interior separator wall 104. Wall 104 subdivides cylinder 102 into a first conduit 105 and a second conduit 107. Column 94 also includes a rotatable support platform 106 at its upper end and a pair of opposed, upwardly extending support arms 108. As shown best in FIG. 16*c*, carousel 92 is adapted to rest on support platform 106 between support arms 108 when carousel 92 and column 94 are assembled together.

In use, rotation of carousel 94 about the axis of shaft 109 causes periodic expansion and contraction of extensible tubes 26 and hence changes in the temperature of working fluid 24 contained therein. At the expanded end of the cycle, heat transfer fluid 10 from hot heat exchanger 18 flows into compartments 96 and past expanded tubes 26 before flowing downwardly into first conduit 105 within cylinder 102 to cold heat exchanger 14. At the same time, on the opposite side of separator wall 104, heat transfer fluid 10 from cold heat exchanger 14 flows upwardly through cylinder conduit 107 into carousel compartments 96 at the cold end of the cycle. As shown in the drawings, the heat transfer fluid 10 flows past contracted tubes 26 before passing to hot heat exchanger 18.

As discussed above, each variable volume compartment 96 essentially constitutes a separate regenerative bed 12. The mean temperature of each regenerative bed 12 depends upon the position of bed 12 in the rotary cycle (i.e. whether extensible tubes 26 are in a relatively contracted configuration or a relatively expanded configuration, corresponding to the variable volume first and second chambers 29, 31 of FIG. 3). As shown best in FIG. 16*d*, the flow direction of heat transfer fluid 10 through each regenerative bed 12 similarly depends upon the position of such bed 12 in the rotary cycle. As in the other embodiments of the invention described above, a temperature gradient is established within each individual regenerative bed 12 (irrespective of its position in the rotary cycle) since the length of each tube 26 (and hence the temperature of working fluid 24 contained therein) varies depends upon its relative radial position. Of course, the radial position of each individual tube 26 is fixed and does not vary during the rotary cycle.

The rotary embodiment of FIGS. 16(*a*)–16(*d*) differs from other embodiments described above in that the flow direction of heat transfer fluid 10 does not periodically reverse. Rather, the relative position of each regenerative bed 12 changes relative to the flow paths of the heat transfer fluid 10 to enact the regenerative refrigeration cycle.

Other design variations are possible without departing from the applicants' invention. As will be apparent to a person skilled in the art, the heat capacity of a gas changes significantly near its critical point (i.e. the point at which it becomes a fluid). The use of a series of working fluids 24, each near its respective critical point, will allow a large change in thermal mass of individual tubes 26 (or individual compartments 58 or vessels 70) upon compression or expansion of working fluid 24 contained therein. This combined variable thermal mass can be arranged to allow a much larger thermal mass in the cold blow of heat transfer fluid 10 (i.e. from cold heat exchanger 14 toward hot heat exchanger 18 across regenerative bed 12) than in the hot blow of heat transfer fluid 10 (i.e. from hot heat exchanger 18 toward cold heat exchanger 14 across regenerative bed 12). This imbalance or asymmetry in the amount of heat transfer fluid 10 required for the two reciprocating flows potentially allows excess heat transfer fluid 10 to be cooled during one part of the cycle. This "excess" heat transfer fluid 10 not required for balanced operation of regenerative bed 12 may be diverted to a separate flow path external to bed 12 to perform useful refrigeration. For example, the excess volume of cooled heat transfer fluid 10 may be diverted to an external process heat exchanger (not shown) to cool and liquefy a separate process stream before returning such heat transfer fluid 10 to the hot end of regenerative bed 12.

Other means for using the changes in thermal mass of tubes 26 (or compartments 58 or vessels 70) during the compression and expansion strokes may be envisioned when the application is in cryogenic temperatures. One approach is to add a layer of magnetic material to create an imbalanced thermal mass in the regenerator as its temperature increases and decreases. The heat capacity of magnetic materials peaks sharply near an ordering temperature such as the Curie temperature in a ferromagnetic order. The heat capacity is significantly larger below the transition temperature than above the transition temperature.

By adding a layer of appropriately chosen magnetic material to a regenerator tube 26 or other vessel containing working fluid 24, the effective thermal mass is significantly imbalanced for the two periodic flows of the heat transfer fluid. For example, introduction of more working fluid 24 into a tube 26 causes working fluid to compress and heat up above the ordering temperature. Conversely, as working fluid exits tube 26 it expands and cools. This temperature decrease is such that the temperature of tube 26 is below the Curie temperature and the thermal mass of the magnetic layer balances the reduction in thermal mass from the exiting fluid 24. The amount of heat transfer fluid in the regenerator from hot to cold is larger than the flow required in the regenerator from cold to hot. The excess heat transfer fluid must be returned via an external path such as via a process heat exchanger where it can cool and liquefy a process stream. The materials can be chosen to have Curie temperatures close to the small operating range of each tube 26 in regenerative bed 12. Further, the materials can be added in thickness to effect the required temperature swings to be above and below the Curie temperatures at appropriate times during the refrigeration cycle.

Figure 17:
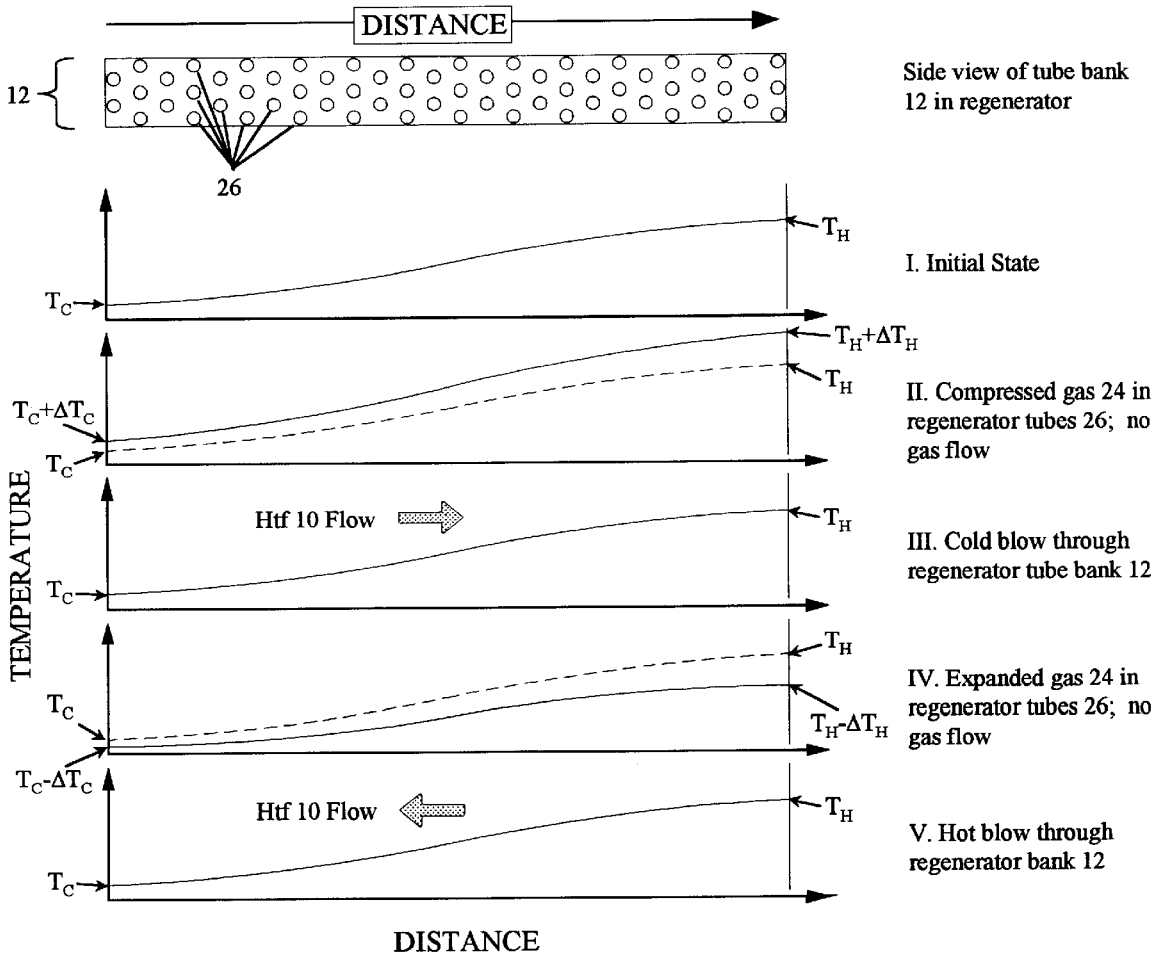
FIG. 17 is a graph showing the temperature profile of the regenerative bed at successive stages in the refrigeration cycle.
Figure 18A:
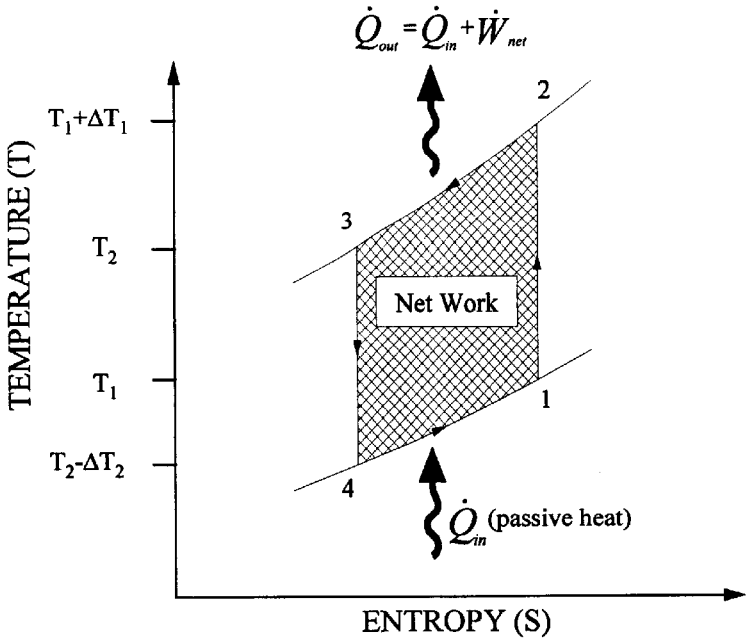
FIG. 18*a* is a temperature-entropy graph showing the ideal Brayton cycle of a single refrigeration element of the regenerator to illustrate the work input and heat flows embodied in the refrigeration cycle.
Figure 18B:
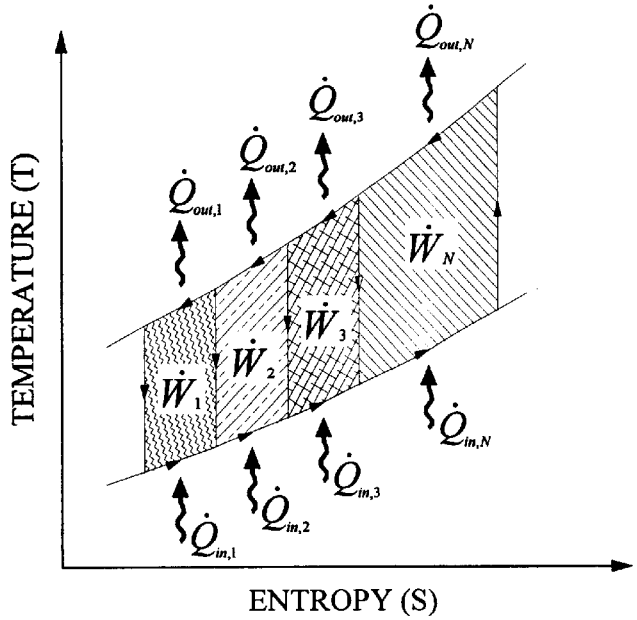
FIG. 18*b* is a temperature-entropy graph showing overlapping Brayton cycles of multiple refrigeration elements.

As should be apparent from the foregoing description, applicants' active regenerative cycle is unique since each refrigeration element 22 undergoes a unique refrigeration cycle based on its relative position in regenerative bed 12 and hence its absolute operating temperature. FIG. 17 shows the temperature distribution of refrigeration elements 22 over an operating cycle. If it assumed that each refrigeration element 22 undergoes a Brayton cycle (i.e. adiabatic compression and isentropic expansion processes linked with two passive heat transfer processes), the total work for a regenerator is the sum of each refrigeration element 22. FIGS. 18*a* and 18*b* illustrate the work input and heat flows associated with operation of applicants' invention, namely a series of separate thermally coupled elements 22 each undergoing a unique refrigeration cycle.

There are two primary thermodynamic constraints directly relevant to applicants' invention. First, the work input must be sufficient to transfer the cooling load across the temperature span to the heat sink including all entropy generated by irreversible losses, i.e.:

$$W_{net}=W_{brayton}+W_{irreversible}$$

Secondly, the adiabatic temperature changes at the hot and cold ends of the regenerative bed 12 must be sufficient to pick up and reject the cooling load.

In order to optimize the efficiency of the refrigeration cycle the irreversible losses must be minimized. There are four major entropy generation mechanisms in the cycle that cause irreversible losses, namely:

(1) Thermal washing effects. These losses are caused by the fact that the thermal mass of the refrigeration elements 22 cannot be infinite when compared to the thermal mass of the heat transfer fluid 10. Accordingly, the heat transfer fluid 10 will "wash" the refrigeration elements 22 of some of their thermal energy and thus lower the possible adiabatic temperature change available (thereby decreasing the work done).

(2) Imperfect heat transfer. The heat transfer rate from the refrigeration elements 22 to the heat transfer fluid 10 will not be infinite. The lower the rate, the greater the temperature approach will be between the heat transfer fluid 10 and elements 22. The greater the temperature approach, the less adiabatic temperature will be available and the greater work input will be required.

(3) Working fluid conduction/mixing. In an ideal regenerative bed 12, the working fluid in each refrigeration element 22 undergoes a unique cycle based on its absolute temperature and the absolute temperature gradually changes over the span between the hot and cold ends of bed 12. In order to work effectively, the working fluid 24 at one temperature must be prevented from mixing with working fluid at different temperatures. Thus a discrete barrier separating each refrigeration element 22 is required. The degree of non-continuity in the temperature profile and conduction across the barrier will cause loss.

(4) Heat transfer between working fluid and tube wall. As the working fluid 24 is compressed or expanded, its temperature will change relative to the tube wall separating it from the heat transfer fluid 10. This temperature difference will produce entropy which will decrease the efficiency of the device.

FIG. 18*a* is a temperature-entropy graph of an ideal Brayton regenerative cycle of a single refrigeration element 22 of the applicant's invention. Initially, at time 1, working fluid 24 within the element 22 is at a temperature $T_1$. Working fluid 24 is then compressed adiabatically so that its temperature at time 2 has increased to $T_{1+\Delta}T_1$. A cold blow of heat transfer fluid 10 (i.e. from cold heat exchanger 14 toward hot heat exchanger 18) is then passed through element 22 to accept heat from working fluid 24, thereby reducing the temperature of working fluid 24 at time 3 to T2. Working fluid 24 is then adiabatically expanded to reduce its temperature at time 4 to $T_{2-\Delta}T_2$. Finally, a hot blow of heat transfer fluid 10 (i.e. from hot heat exchanger 18 toward cold heat exchanger 14) is passed through element 22 to return the temperature of working fluid 22 to temperature $T_1$ to complete the cycle.

The passive heat input of the cycle, $Q_{in}$, is represented in FIG. 18*a* by the area under curve 1–4; and the heat output of the cycle, $Q_{out}$, is represented by the area underneath curve 2–3. The difference between $Q_{out}$ and $Q_{in}$ is determined by the work inputted into the cycle, $W_{net}$, to effect periodic compression and expansion of working fluid 24.

FIG. 18*b* is temperature-entropy graph of a plurality of refrigeration elements 22 of the applicant's invention having overlapping regenerative cycles. By providing a series of elements 22 each operating at their own mean temperature, the temperature difference which regenerative bed 12 can span is increased accordingly (i.e. a larger temperature gradient is created across regenerative bed 12). Further, a bank of elements 22 could be provided in parallel at each discrete temperature in the gradient to increase the heat transfer/cooling capacity of the system.

As should also be apparent from the above description, applicants' invention is a heat transfer apparatus and method that may be easily tailored to suit a wide variety of applications. Although the invention has been primarily described with reference to refrigerators, it may have application as an air conditioner, ventilator, heat pump, heat exchanger and the like.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A heat transfer apparatus employing an active regenerative cycle for transferring beat from a thermal load to a heat sink comprising (A) a regenerator comprising working fluid contained in a plurality of separate first vessels arranged in an ordered array, each of said first vessels having a designated location between said thermal load and said heat sink and having a mean operating temperature corresponding to said designated location;

(B) a heat transfer fluid physically separated from said working fluid and in thermal communication with said thermal load and said heat sink;

(C) work input means for periodically compressing and expanding said working fluid to alternatively increase and decrease the temperature thereof; and (D) circulation means for periodically circulating said heat transfer fluid relative to said working fluid to either accept heat from or transfer heat to said working fluid.

2. The heat transfer apparatus of claim 1, wherein said heat transfer fluid moves between said thermal load and said heat sink in an oscillatory manner.

3. The heat transfer apparatus of claim 1, wherein said work input means is moveable relative to each of said first vessels to compress a first sub-volume of said working fluid in a first portion thereof and simultaneously cause expansion of a second sub-volume of said fluid in a second portion thereof.

4. The heat transfer apparatus of claim 1, wherein each of said first vessels is thermally isolated from the remainder of said first vessels and wherein the operating temperature of each of said first vessels depends upon said designated location.

5. The heat transfer apparatus of claim 4, further comprising at least one heat transfer channel for confining said heat transfer fluid, wherein said at least one heat transfer channel spans a temperature gradient extending across said regenerator.

6. The heat transfer apparatus of claim 5, wherein said first vessels comprise an upper vessel, a lower vessel and a plurality of intermediate vessels spaced between said upper and lower vessels, and wherein said system further comprises:

(A) a high temperature heat transfer system for receiving said heat transfer fluid leaving said heat transfer channel after passing said upper vessel and transferring heat therefrom to said heat sink and for returning said heat transfer fluid to said heat transfer channel; and (B) a low temperature heat transfer system for transferring heat from said thermal load to said heat transfer fluid after said heat transfer fluid has passed said lower vessel.

7. The heat transfer system of claim 1, further comprising at least one second vessel for containing said heat transfer fluid.

8. The heat transfer system of claim 7, wherein said plurality of separate first vessels are located within said second vessel.

9. A heat transfer apparatus employing art active regenerative cycle for transferring heat from a thermal load to a heat sink comprising (A) a regenerator comprising working fluid contained within at least one first vessel;

(B) a heat transfer fluid contained within at least one second vessel, wherein said heat transfer fluid is physically separated from said working fluid and is in thermal communication with said thermal load and said heat sink;

(C) work input weans for periodically compressing and expanding said working fluid to alternatively increase and decrease the temperature thereof; and (D) circulation means for periodically circulating said heat transfer fluid relative to said working fluid to either accept heat from or transfer heat to said working fluid.

10. The heat transfer system of claim 9, wherein said at least one second vessel is located within said first vessel.

11. The heat transfer system of claim 4, wherein said work input means comprises:

(A) a third vessel in fluid communication with each of said first vessels for holding said working fluid; and (B) a compressor for periodically compressing and expanding said working fluid in said third vessel to cause corresponding compression and expansion cycles in each of said first vessels, wherein said working fluid in said third vessel is thermally isolated from said working fluid in said first vessels.

12. The heat transfer system of claim 11, further comprising a plurality of passive regenerators for operatively coupling said third vessel to each of said first vessels.

13. The heat transfer system of claim 4, wherein each of said first vessels comprises an elongated tube and wherein said work input means is moveable relative to a longitudinal axis thereof.

14. The heat transfer system of claim 13, wherein said work input means comprises a shuttle mounted for reciprocal movement in said tube.

15. The heat transfer system of claim 13, wherein said tubes are arranged in a parallel array and wherein said longitudinal axis of each of said tubes extends in a direction generally perpendicular to the flow path of said heat transfer fluid.

16. A method of enacting an active regenerative refrigeration cycle for transferring heat from a thermal load to a heat sink comprising:

(A) providing a regenerator spanning a temperature gradient between said thermal load and said heat sink, said regenerator comprising a plurality of separate refrigeration elements each containing a working fluid and having a designated position in said temperature gradient;

(B) providing a heat transfer fluid physically separated from said working fluid and movable relative to said refrigeration elements across said temperature gradient between said thermal load and said heat sink;

(C) compressing said working fluid contained in each of said refrigeration elements to increase the temperature thereof;

(D) moving said heat transfer fluid relative to said refrigeration elements in a flow direction from said thermal load toward said heat sink;

(E) expanding said working fluid contained in each of said refrigeration elements to decrease the temperature thereof; and (F) moving said heat transfer fluid relative to said refrigeration elements in a flow direction from said heat sink toward said thermal load.

17. The method of claim 16, further comprising repeating steps (C)–(F) successively.

18. The method of claim 16, where said heat transfer fluid moves between said thermal load and said heat sink in an oscillatory manner.

19. The method of claim 16, wherein steps (C) and (D) occur simultaneously, and wherein steps (E) and (F) occur simultaneously.

20. A regenerative heat transfer device for transferring heat between a thermal load and a heat sink comprising:

(a) an array of discrete refrigeration elements spaced apart at intermediate locations between said thermal load and said heat sink, wherein each of said refrigeration elements contains a working fluid and has a mean operating temperature corresponding to its relative location between said thermal load and said heat sink;

(b) an actuator for periodically compressing and expanding said working fluid to thereby increase or decrease the temperature of said refrigeration elements; and (c) a circulator for circulating a heat transfer fluid in a flow path between said thermal load and said heat sink, wherein said heat transfer fluid passes relative to said array of refrigeration elements to either accept heat from or transfer heat to said refrigeration elements.

21. The device of claim 20, wherein said working fluid in each of said refrigeration elements is sequentially compressed and expanded in alternating working cycles, wherein said working cycles coincide in each of said refrigeration elements.

22. The device of claim 20, wherein each of said refrigeration elements comprises two separate sealed chambers each containing a volume of said working fluid, wherein said actuator is moveable relative to each of said refrigeration elements to compress said working fluid in one of said chambers and simultaneously expand said working fluid in the other of said chambers, thereby enabling work recovery.

23. The device of claim 20, further comprising a cold heat exchanger for exchanging heat from said thermal load to said heat transfer fluid; and a hot heat exchanger for exchanging heat from said heat transfer fluid to said heat sink.

24. The device of claim 20, wherein said working fluid comprises one or more gases or mixtures thereof, wherein the composition of said working fluid contained in each of said refrigeration elements varies depending upon said mean operating temperature.

25. The device of claim 24, wherein said working fluid contained in each of said refrigeration elements is near its critical point.

26. The device of claim 20, wherein said actuator comprises a rotary drive for rotating said array of refrigeration elements to compress and expand said working fluid over the arc of rotation to thereby increase or decrease the temperature of said refrigeration elements.

27. The device of claim 20, wherein said actuator comprises means for varying the volume of said refrigeration elements.

28. The device of claim 20, wherein said actuator comprises a plurality of pistons, wherein each of said pistons is mounted for reciprocating movement in a corresponding one of said refrigeration elements.

29. The device of claim 28, wherein said actuator further comprises a controller for actuating movement of all of said pistons in unison.

30. The device of claim 20, wherein said actuator comprises a compressor for introducing working fluid into, and withdrawing working fluid from, said refrigeration elements.

31. The device of claim 30, further comprising at least one passive regenerator for operatively coupling said compressor to each of said refrigeration elements, wherein said passive regenerator maintains a temperature gradient across said array of discrete refrigeration elements.

32. The device of claim 20, wherein said circulator comprises a duct for confining said heat transfer fluid to said flow path, wherein at least a portion of each of said refrigeration elements extends into said duct.

33. The device of claim 20, wherein each of said refrigeration elements comprises a thin-walled elongate tube having a longitudinal axis extending parallel to the longitudinal axis of each of the other of said refrigeration elements in said array.

34. The device of claim 20, wherein said heat transfer fluid is air and said circulator comprises an air pump.

35. A refrigeration element comprising:

(a) a container for holding a working fluid;

(b) at least one conduit extending within said container for holding a heat transfer fluid separate from said working fluid; and (c) an actuator for periodically compressing and expanding said working fluid to vary the temperature of said working fluid.

36. The refrigeration element of claim 35, wherein said actuator compresses said container.

37. The refrigeration element of claim 35, wherein said conduit comprises an inlet and an outlet for connecting said conduit to a volume of heat transfer fluid external to said container.

38. The refrigeration element of claim 35, wherein said container comprises at least two separate chambers each containing a volume of said working fluid, wherein said actuator is moveable relative to said container to compress said working fluid in one of said chambers and simultaneously expand said working fluid in the other of said chambers, thereby enabling work recovery.

39. A regenerative refrigerator comprising a plurality of refrigeration elements as defined in claim 35 connected together such that said heat transfer fluid in adjacent pairs of said elements is in fluid communication.

40. A regenerative refrigerator as defined in claim 39, wherein one of said elements receives said heat transfer fluid from a thermal load and another one of said elements transfers said heat transfer fluid to a heat sink.

41. A regenerative refrigerator as defined in claim 39, wherein each of said plurality of refrigeration elements is thermally isolated.

42. A regenerative refrigerator as defined in claim 41, wherein said refrigeration elements are stackable.

43. A refrigeration element as defined in claim 35, wherein said container comprises thermally non-conductive sections.

44. The heat transfer system of claim 10, comprising a plurality of second vessels located within said first vessel each of said second vessels spanning a temperature gradient extending across said regenerator.

45. A heat transfer apparatus employing an active regenerative cycle for transferring heat from a thermal load to a heat sink comprising (A) a regenerator comprising contained working fluid;

(B) a heat transfer fluid physically separated from said working fluid and in thermal communication with said thermal load and said heat sink;

(C) work input means for periodically compressing and expanding said working fluid to alternatively increase and decrease the temperature thereof; and (D) circulation means for periodically circulating said heat transfer fluid relative to said working fluid to either accept heat from or transfer heat to said working fluid, wherein said heat transfer fluid moves between said thermal load and said heat sink in an oscillatory manner.

46. A regenerative heat transfer device for transferring heat across a temperature gradient between a thermal load and a heat sink comprising:

(a) a regenerator comprising an array of discrete refrigeration elements spaced apart at intermediate locations between said thermal load and said heat sink, wherein each of said refrigeration elements contains a working fluid and has a mean operating temperature corresponding to its relative location between said thermal load and said heat sink;

(b) an actuator for periodically compressing and expanding said working fluid to thereby increase or decrease the temperature of said refrigeration elements; and (c) a circulator for circulating a heat transfer fluid relative to said array of refrigeration elements to either accept heat from or transfer heat to said refrigeration elements, wherein said heat transfer fluid is moveable in a first flow path within said regenerator between said thermal load and said heat sink and a second flow path between said regenerator and an auxiliary device capable of accepting or rejecting heat located externally of said regenerator, whereby a portion of said heat transfer fluid is divertable to said auxiliary device.

47. The heat transfer device of claim 46, wherein said auxiliary device is a heat exchanger.

48. A method of cooling a thermal load comprising (a) providing a regenerator comprising an array of discrete refrigeration elements spaced apart at intermediate locations across a temperature gradient, wherein each of said refrigeration elements contains a working fluid and has a mean operating temperature corresponding to its relative location in said temperature gradient;

(b) periodically compressing and expanding said working fluid to thereby increase or decrease the temperature of said refrigeration elements,; and (c) periodically circulating a heat transfer fluid relative to said array of refrigeration elements to either accept heat from or transfer heat to said refrigeration elements, wherein a portion of said heat transfer fluid is further conveyed to a thermal load located externally of said regenerator to accept heat therefrom.

49. A regenerative heat transfer device comprising a plurality of refrigeration elements, wherein each of said refrigeration elements comprises:

(a) a container for holding a working fluid;

(b) at least one conduit extending within said container for holding a heat transfer fluid separate from said working fluid; and (c) an actuator for periodically compressing and expanding said working fluid to vary the temperature of said working fluid, wherein said refrigeration elements are connected together such that said heat transfer fluid in adjacent pairs of said elements is in fluid communication.

* * * * *